US012024359B2

(12) United States Patent
Kuo et al.

(10) Patent No.: US 12,024,359 B2
(45) Date of Patent: Jul. 2, 2024

(54) STICK-SHAPED PAPER CONTAINER

(71) Applicants: Golden Arrow Printing Technology Co., LTD., New Taipei (TW); L'Oreal, Paris (FR)

(72) Inventors: Chien-Kuan Kuo, New Taipei (TW); Chun-Huang Huang, New Taipei (TW); Simon Nicholas Dutton, Basking Ridge, NJ (US)

(73) Assignees: Golden Arrow Printing Technology Co., LTD., New Taipei (TW); L'Oreal, Paris (FR)

( * ) Notice: Subject to any disclaimer, the term of this patent is extended or adjusted under 35 U.S.C. 154(b) by 193 days.

(21) Appl. No.: 17/322,896

(22) Filed: May 17, 2021

(65) Prior Publication Data

US 2022/0363434 A1 Nov. 17, 2022

(51) Int. Cl.
*B65D 8/00* (2006.01)
*A45D 40/00* (2006.01)
*B65D 6/34* (2006.01)

(52) U.S. Cl.
CPC ..... *B65D 9/02* (2013.01); *A45D 40/00* (2013.01); *B65D 9/34* (2013.01); *A45D 2040/0025* (2013.01); *A45D 2200/05* (2013.01)

(58) Field of Classification Search
CPC ... B65D 9/02; B65D 9/34; B65D 1/14; B65D 75/5888; B65D 3/262; B65D 2565/382; B65D 65/466; A45D 40/00; A45D 2040/0025; A45D 2200/05; D21J 3/04; Y02W 90/10
USPC ..... 229/4.5, 101.1, 201; 206/385
See application file for complete search history.

(56) References Cited

U.S. PATENT DOCUMENTS

| | | | | |
|---|---|---|---|---|
| 2,368,044 A * | 1/1945 | Seager | A45D 40/06 401/61 |
| 5,217,164 A * | 6/1993 | Sullivan | B65D 75/5888 206/385 |
| 11,547,198 B2 * | 1/2023 | Thulin | A45D 40/14 |
| 2022/0097335 A1 * | 3/2022 | Skelton | A45D 40/16 |

FOREIGN PATENT DOCUMENTS

WO 2020/019098 A1 1/2020

* cited by examiner

*Primary Examiner* — Christopher R Demeree
(74) *Attorney, Agent, or Firm* — Christensen O'Connor Johnson Kindness PLLC

(57) ABSTRACT

A stick-shaped paper container according to the present invention is introduced herein, and comprises a covering body, a base seat and a sleeving unit, the respective entire structure of all which is integrally compression-molded with only rendering positive draft angles, respectively, only by a wet-fiber pulp-molding process applied for wet plant-fibrous pulps, thereby being capable of simplifying its mold assembly and lowering its mold cost. The covering body, the sleeving unit and the base seat are assembled together into the entire stick-shaped paper container having a container height-to-width ratio between 2~5.5.

16 Claims, 7 Drawing Sheets

STICK-SHAPED PAPER CONTAINER

FIELD OF THE INVENTION

The present invention relates to a paper container applied in the technical field of a packaging material, and more particularly, is related to a stick-shaped paper container fabricated by a wet-fiber pulp-molding process.

BACKGROUND OF THE INVENTION

To speed up the manufacture for the conventional packaging container, mostly conventional packaging containers are integrally formed with several components thereof in plastic materials, or is assembled together with a few of paper parts and a few of plastic parts. This could not accomplish the latest environmental protection requirements for biodegradability or compostability; furthermore, if consumers' bodies, such as their lips or skins, frequently touch the plastic container (such as plastic packaging materials for lipsticks or cosmetics), it is liable to invoke healthy doubts for the human body, after a prolonged period. Presently, as depicted in FIG. 1, although a series of consistent production machines 1 where two coupled upper male mold 22 and lower female mold 24 are mutually compression-matched for wet plant-fibrous slurries positioned therebetween are deployed in a production line used for the conventional pulp-molding process (or so-called "wet-fiber pulp-molding process"), thereby integrally shaping a variety of huge 3C paper packaging materials from the slurries. Nevertheless, the conventional pulp-molding process exists with the following technical drawbacks: (1) during the conventional pulp-molding process after a dredging-pulp cave chamber 242 of the lower female mold 24 is configured to dredge up the wet plant-fibrous pulps 28 (or called "dredging-pulp") within from a slurry tank 26, then the lower female mold 24 and the upper male mold 22 both implement compression-molding together, a ratio R1 that a longitudinal molding depth H1 of the dredging-pulp cave chamber 242 of the lower female mold 24 is relative to a transversal molding width W1 of each side of the dredging-pulp cave chamber 242 mostly is restricted to be smaller than or equal to '1' (namely $H1/W1=R1$, $R1\leq 1$). Through the upper male mold 22 and the lower female mold 24 both mutually compression-matching, a conventional pulp-molded article 16 is finalized in forming an integral shape which is frequently rendered in a compacted-and-flatted box body (as treated for a 3C packaging material) where its transversal width w1' is equal to or larger than its longitudinal height h1'; namely a ratio r1 of the conventional pulp-molded article 16 that the longitudinal height h1' (in parallel to the longitudinal molding depth H1) is relative to the transversal width w1' is smaller than or equal to '1' (namely $h1'/w1'=r1$, $r1\leq 1$). If the transversal molding width W1 of the dredging-pulp cave chamber 242 of the lower female mold 24 is too small as well as the longitudinal molding depth H1 is too deep (namely its ratio R1 is larger than '1'), such a stick-shaped pulp-molded article possibly incurs a 'crosslinking effect' along a longitudinally molding aspect of the mold during its molding process. It represents that the molding process of the stick-shaped pulp-molded article will invoke its longitudinal sidewalls readily broken or having a too-thin thickness insufficient to provide a structural strength. This would lead to a drawback of a poor production yield.

Furthermore, while the stick-shaped pulp-molded article is fabricated by the conventional pulp-molding process, if the longitudinal sidewalls of the stick-shaped pulp-molded article need to be molded together with laterally latch structure and/or laterally recessed structure thereon, various demold surfaces of the laterally latch structure and/or the laterally recessed structure would be rendered in negative draft angles with relation to two longitudinal demolding directions of both the upper male and lower female molds 22, 24, as collectively using a longitudinal centre line T1 (or so-called 'a vertical demolding direction'), whereas various demold surfaces of the other resting portions, such as its longitudinal sidewalls and its corresponding transversal bottom sidewalls, of the stick-shaped pulp-molded article are rendered in positive draft angles. This would invoke that after the article is being molded, the upper male and lower female molds both are longitudinally demolded as well as another transversal mold is horizontally demolded and/or a slidable block device is horizontally moved in cooperation therewith, thereby collaboratively molding the entire stick-shaped pulp-molded article which comprises the laterally latch structure and/or laterally recessed structure formed thereon. Understandingly, if the stick-shaped pulp-molded article has simultaneously different portions which are respectively rendered in both positive draft angles and negative draft angles, it would make the amount of the require mold components becoming increased and complex, for using with the conventional pulp-molding process. This will be bound to raise its mold device cost higher, make its repair difficulty growing, cause its production yield worse, and extend its cycle time of the production for the respective articles, simultaneously. Please refer to a PCT International Publication No. WO2020019098A1 that has been introduced, where an outer surface of an upper cover 10 is provided with a plurality of straight grooves 11 thereon, and an outer surface of a lower cover 20 is provided with a plurality of straight-and-large grooves 21 each formed with a step surface 23 on an inner side of an lower inner cavity 22 thereof, wherein the grooves 11, the straight-and-large grooves 21 and the step surface 23 (as a laterally latch structure) all that are laterally molded at negative draft angles, need to use another transversal mold implemented for a horizontally demolding, and/or a slidable block device implemented for a horizontal movement, in addition to cooperation together with the two male and female molds both implemented for the longitudinal demolding.

Hence, there is a demand to provide a stick-shaped paper container fabricated by an improved pulp-molding process, for resolving the afore-mentioned technical problems incurred in the conventional pulp-molding container made by the conventional pulp-molding process.

SUMMARY OF THE INVENTION

In order to solve a variety of technical matters incurred in the prior arts, a primary objective of the present invention is to provide a stick-shaped paper container, all components of which comprises, for example, a sleeving unit, a covering body, a base seat and so forth, and are capable of being integrally molded by a consistent-and-continuous production machine used with an improved pulp-molding process. This does not only lead to resolve a technical problem of the conventional pulp-molding process that is incapable of producing such a pulp-molded article which has a height-to-width ratio, greater than one, of its maximum longitudinal height being relative to its maximum transversal width, but also saves its working cycle time, benefits its mass production, and assures its higher product yield and quality.

Furthermore, another objective of the present invention is to provide a stick-shaped paper container, which adopts the pure plant fibers as materials for constituting the container, in order to avoid occurrence of the human healthy doubt and to conform with the FDA food-grade certification standard, thereby actually accomplishing an environmental protection requirement for both biodegradability and compostability.

Furthermore, another objective of the present invention is to provide a stick-shaped paper container, the components of which primarily comprises the sleeving unit, the covering body and the base seat, and have the respective demold surfaces all rendering only in positive draft angles relative to a longitudinal demolding direction of a compression-molding mold assembly used with the wet-fiber pulp-molding process, rather than the negative draft angles rendered in the laterally latch structure and/or laterally recessed structure of the conventional pulp-molded article are rendered. Accordingly, during the molding process, it would be unnecessary to employ a transversal mold implemented extra for a horizontally demolding, and/or a slidable block device implemented extra for a horizontal movement, thereby being capable of simplifying the mold assembly, and lowering its mold cost.

To accomplish the afore-mentioned objectives, a preferred embodiment of the present invention adopts the following technical solutions where a stick-shaped paper container, configured for accommodating a content therein, comprises: a sleeving unit, a covering body and a base seat.

The sleeving unit configured for restricting the content from transversal movement has a first and second end both opposed against each other, an annularly standing sleeve wall located between the first and second ends and formed around a longitudinal centre line, and a hollowed sleeve chamber formed, along the longitudinal centre line, between the first and second ends, wherein the first end is formed with a first opening space-communicated with the hollowed sleeve chamber and provided for the content passing therethrough, the hollowed sleeve chamber is formed with an innermost sleeve sidewall in a position of propping the content, and the standing sleeve wall is formed with an outermost sleeve sidewall.

The covering body has a closed top distal end, a fitting-on distal end opposed against the top distal end, a standing cover wall located between the top distal end and the fitting-on distal end and formed around the longitudinal centre line, and a hollowed cover chamber formed, along the longitudinal centre line, between the top distal end and the fitting-on distal end, wherein the fitting-on distal end is formed with a fitting-on opening space-communicated with the hollowed cover chamber, the hollowed cover chamber is formed with an innermost cover sidewall therein, the fitting-on distal end of the covering body is disposed at a position corresponding to the first end of the sleeving unit, and the standing cover wall has an outermost cover sidewall.

The base seat configured for longitudinally supporting the content has a closed bottom terminal, an abutting terminal opposed against the bottom terminal, a hollowed base chamber formed, along the longitudinal centre line, between the bottom terminal and the abutting terminal, and a standing base wall located between the bottom terminal and the abutting terminal and formed around the longitudinal centre line, wherein the abutting terminal is formed with a receiving opening space-communicated with the hollowed base chamber, the abutting terminal of the base seat is disposed at a position corresponding to the second end of the sleeving unit, thereby accommodating the content within between both the covering body and the base seat, and the standing base wall has an outermost base sidewall.

Preferably, the covering body and the base seat both are integrally formed, respectively, only by a wet-fiber pulp-molding process where a male mold dredges up wet plant-fibrous pulps and then the male mold and a female mold both compression-mold the wet plant-fibrous pulps, in such a way that the entire structure of each of the covering body and the base seat all is formed with positive draft angles relative to the longitudinal centre line, wherein the covering body, the sleeving unit and the base seat are assembled together into the entire stick-shaped paper container which has a maximum container height parallel to the longitudinal centre line, a maximum container width perpendicular to the longitudinal centre line, and a container height-to-width ratio, between 2~5.5, of the maximum container height being relative to the maximum container width.

Preferably, the sleeving unit is integrally formed, by the wet-fiber pulp-molding process where the male mold dredges up the wet plant-fibrous pulps and then the male mold and the female mold both compression-mold the wet plant-fibrous pulps, in such a way that the entire structure of the sleeving unit is formed with positive draft angles relative to the longitudinal centre line.

Preferably, the outermost sleeve sidewall is divided, by along the longitudinal centre line, into an annularly outer narrow-diameter section, an annularly outer wide-diameter section, and an outer circular saddle formed on a boundary between the outer narrow-diameter section and the outer wide-diameter section. The first end of the sleeving unit passes through the fitting-on opening of the covering body to enter inside the hollowed cover chamber while the fitting-on distal end is disposed with the first end, wherein the innermost cover sidewall and the outer narrow-diameter section both are respectively formed with flatted surfaces longitudinally extended in such a way of constituting a plane-to-plane tight contact in a mutually resting-on manner between the innermost cover sidewall and the outer narrow-diameter section, and an inner diameter of the fitting-on opening is smaller than an outer diameter of the outer circular saddle, thereby blocking the fitting-on distal end on the outer circular saddle from moving.

Preferably, the second end of the sleeving unit formed with a second opening space-communicated with the hollowed sleeve chamber, and the innermost sleeve sidewall is divided, by along the longitudinal centre line, into an annularly-narrowed inner diameter section, an annularly-widened inner diameter section, and an inner circular saddle formed on a boundary between both the annularly-narrowed inner diameter section and the annularly-widened inner diameter, wherein the abutting terminal passes through the second opening of the sleeving unit to enter inside the hollowed sleeve chamber while the abutting terminal is disposed with the second end, the annularly-widened inner diameter section and the outermost base sidewall both have flatted surfaces extended toward the same direction in such a way of constituting a plane-to-plane tight contact in a mutually resting-on manner between the annularly-widened inner diameter section and the outermost base sidewall, and an outer diameter of the abutting terminal is smaller than an inner diameter of the inner circular saddle and smaller than the inner diameter of the fitting-on opening of the covering body, thereby blocking the abutting terminal on the inner circular saddle from moving.

Preferably, the sleeving unit is constituted by assembling at least two sleeves in a nested or stacked manner along the longitudinal centre line.

Preferably, while the at least two sleeves are assembled in the nested manner, the content is restricted from both transversal and longitudinal movements within between the at least two sleeves, by an interlocking retention between a couple of interlocking components respectively formed on the at least two sleeves.

Preferably, the covering body and the base seat both are substantially the same in their entire structure and dimension, wherein while the covering body, the sleeving unit and the base seat are assembled together into the entire stick-shaped paper container, the covering body and the base seat both are disposed in a reverse-position manner with relative to each other.

Preferably, after the covering body and the sleeving unit both are assembled together, the covering body and the sleeving unit both are respectively positioned with the corresponding positive draft angles relative to the longitudinal centre line.

Preferably, after the covering body, the sleeving unit and the base seat are assembled together into the entire stick-shaped paper container, the second end of the sleeving unit rests on an inner sidewall of the bottom terminal of the base seat.

Preferably, the outermost cover sidewall and the outermost base sidewall both are respectively formed with flatted surfaces extended toward the same direction.

Preferably, a transversally cross-sectional thickness of the standing cover wall is smaller or larger than a transversally cross-sectional thickness of the standing base wall.

Preferably, the innermost seat sidewall is divided, by along the longitudinal centre line, into an annularly-narrowed inner diameter section, an annularly-widened inner diameter section, and an inner circular saddle formed on a boundary between both the annularly-narrowed inner diameter section and the annularly-widened inner diameter, wherein the second end passes through the receiving opening to enter inside the hollowed base chamber while the abutting terminal is disposed with the second end, the annularly-widened inner diameter section and the outermost sleeve sidewall both are respectively formed with flatted surfaces extended toward the same direction in such a way of constituting a plane-to-plane tight contact in a mutually resting-on manner between the annularly-widened inner diameter section and the outermost sleeve sidewall, and an outer diameter of the second end is smaller than an inner diameter of the inner circular saddle, thereby blocking the second end on the inner circular saddle from moving.

Preferably, an outer diameter of the abutting terminal of the base seat is smaller than an inner diameter of the second opening of the sleeving unit and smaller than an inner diameter of the fitting-on opening of the covering body.

Preferably, while the container height-to-width ratio is between 2~5.5, the maximum container width is between 12~23 mm.

Furthermore, another preferred embodiment of the present invention adopts the following technical solutions where a stick-shaped paper container, configured for accommodating a content therein, comprises a covering body and a base seat.

The covering body has a closed top distal end, a fitting-on distal end opposed against the top distal end, a standing cover wall located between the top distal end and the fitting-on distal end and formed around a longitudinal centre line, and a hollowed cover chamber formed, along the longitudinal centre line, between the top distal end and the fitting-on distal end, wherein the fitting-on distal end is formed with a fitting-on opening space-communicated with the hollowed cover chamber, and the hollowed cover chamber is formed with an innermost cover sidewall therein.

The base seat is configured for longitudinally supporting the content and has a closed bottom terminal, an abutting terminal opposed against the bottom terminal, a hollowed base chamber formed, along the longitudinal centre line, between the bottom terminal and the abutting terminal, and a standing base wall located between the bottom terminal and the abutting terminal and formed around the longitudinal centre line, wherein the abutting terminal is formed with a receiving opening space-communicated with the hollowed base chamber, the abutting terminal of the base seat is disposed at a position corresponding to the fitting-on distal end of the covering body, thereby accommodating the content within between both the covering body and the base seat.

Preferably, the covering body and the base seat both are integrally formed, respectively, only by a wet-fiber pulp-molding process where a male mold dredges up wet plant-fibrous pulps and then the male mold and a female mold both compression-mold the wet plant-fibrous pulps, in such a way that the entire structure of each of the covering body and the base seat all is formed with positive draft angles relative to the longitudinal centre line, and the stick-shaped paper container is constituted only by assembling the covering body and the base seat together.

Preferably, the stick-shaped paper container has a maximum container height parallel to the longitudinal centre line, a maximum container width perpendicular to the longitudinal centre line, and a container height-to-width ratio, between 2~5.5, of the maximum container height being relative to the maximum container width.

Furthermore, another preferred embodiment of the present invention adopts the following technical solutions where a stick-shaped paper container, configured for accommodating a content therein, comprises a sleeving unit and a covering body.

The sleeving unit configured for restricting the content from movement has a first and second end both opposed against each other, an annularly standing sleeve wall located between the first and second ends and formed around a longitudinal centre line, and a hollowed sleeve chamber formed, along the longitudinal centre line, between the first and second ends, wherein the first end is formed with a first opening space-communicated with the hollowed sleeve chamber and provided for the content passing therethrough, the hollowed sleeve chamber is formed with an innermost sleeve sidewall in a position of propping the content, and the standing sleeve wall is formed with an outermost sleeve sidewall.

The covering body has a closed top distal end, a fitting-on distal end opposed against the top distal end, a standing cover wall located between the top distal end and the fitting-on distal end and formed around the longitudinal centre line, and a hollowed cover chamber formed, along the longitudinal centre line, between the top distal end and the fitting-on distal end, wherein the fitting-on distal end is formed with a fitting-on opening space-communicated with the hollowed cover chamber, the hollowed cover chamber is formed with an innermost cover sidewall therein, the covering body is disposed at a position corresponding to the sleeving unit.

Preferably, after the covering body and the sleeving unit both are integrally formed, respectively, only by a wet-fiber pulp-molding process where a male mold dredges up wet plant-fibrous pulps and then the male mold and a female mold both compression-mold the wet plant-fibrous pulps, the entire structure of each of the covering body and the sleeving unit is formed with positive draft angles relative to the longitudinal centre line, and the stick-shaped paper container is constituted only by assembling the covering body and the sleeving unit together.

Preferably, the innermost cover sidewall is divided, by along the longitudinal centre line, into an annularly-narrowed inner diameter section, an annularly-widened inner diameter section, and a first outer circular saddle formed on an end of the annularly-widened inner diameter section and outwardly extended, and the outermost sleeve sidewall is outwardly extended and is formed with a second outer circular saddle thereon, wherein the first end of the sleeving unit passes through the fitting-on opening to enter inside the hollowed cover chamber while the covering body is disposed with the sleeving unit, the annularly-widened inner diameter section and the outermost sleeve sidewall both are respectively formed with smoothly curved surfaces obliquely extended in such a way of constituting a plane-to-plane tight contact in a mutually resting-on manner between the annularly-widened inner diameter section and the outermost sleeve sidewall, and an outer diameter of the second end is larger than an inner diameter of the fitting-on opening, thereby blocking the second outer circular saddle on a bottom side of the first outer circular saddle from moving.

Consequently, the present invention can effect the following technical benefits that: compared with the prior arts, each of all components of the stick-shaped paper container according to the present invention, is capable of being integrally molded, respectively, by consistent-and-continuous production machines of a production line used with an improved wet-fibrous pulp-molding process. This does not only resolve the technical drawback of the conventional pulp-molding process that is incapable of producing such a pulp-molded article having a height-to-width ratio, greater than one, of its maximum longitudinal height being relative to maximum transversal width, but also reduces its working cycle time, benefits its mass production, and assures its higher product yield and quality. Furthermore, each of all components of the stick-shaped paper container according to the present invention, has the respective demold surfaces all rendered only in positive draft angles relative to a longitudinally demolding direction of a compression-molding mold assembly used with the wet-fiber pulp-molding process, rather than negative draft angles relative to the longitudinally demolding direction, as rendered in the laterally latch structure and/or laterally recessed structure of the conventional pulp-molded article. Thus, the present invention does not need to additionally use the other transversal mold implemented for a horizontally demolding, and/or a slidable block device implemented for a horizontal movement, thereby being capable of simplifying the mold assembly, and lowering its mold cost.

DESCRIPTION OF THE DIAGRAMS

DETAILED DESCRIPTION OF THE PREFERRED EMBODIMENTS

Figure 1:
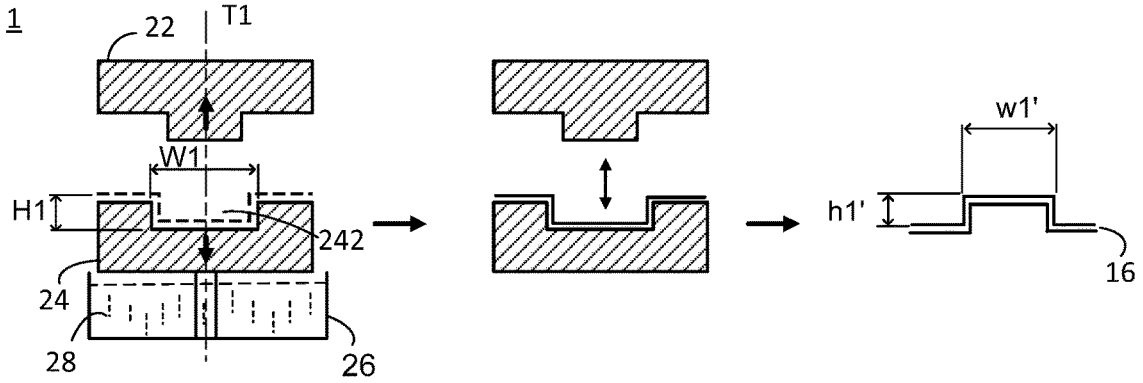
Fig. 1 (Prior Art)
FIG. 1 depicts a schematic diagram of consistent production machines allocated in a production line used with a conventional pulp-molding process.

The technical proposals in the embodiments of the present invention will be clearly and completely described in the following with reference to the companying drawings of the embodiments of the present invention. The directional terms mentioned in the present invention, such as "upper", "lower", "before", "after", "left", "right", "inside", "outside", "side", etc., are merely illustrative the direction of the drawing. Therefore, the directional terminology used is for the purpose of illustration and understanding of the invention, which is not intended to limit the invention.

Figure 2:
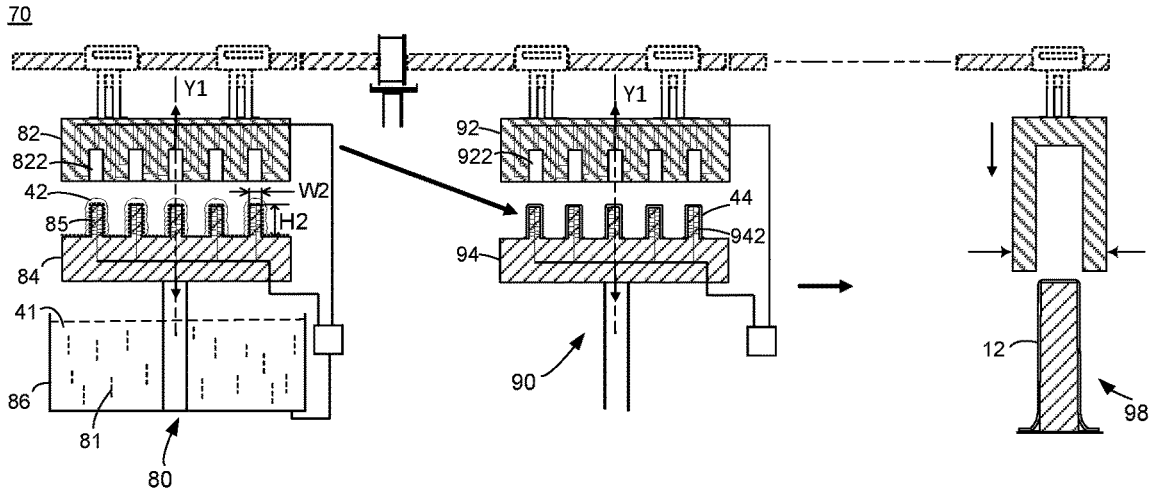
FIG. 2 depicts a schematically cross-sectional diagram of consistently automatic production machines allocated in a production line used with an improved wet-fiber pulp-molding process, according to the present invention.

First of all, please refer to an illustration shown in FIG. 2, which depicts a schematically cross-sectional diagram of consistently automatic production machines 70 allocated in a production line used with an improved wet-fiber pulp-molding process, according to the present invention. The consistently automatic production machines 70 allocated in the production line used with the improved wet-fiber pulp-molding process, is primarily configured with at least one actuating-to-move apparatus (not shown), a dredging-pulp and pre-compression device 80, a vacuum exhausting device (not shown), a thermo-compression-molding device 90 and a trimming-off device 98.

The dredging-pulp and pre-compression device 80 comprises a first female mold 82 located on an upper portion thereof, and a first male mold 84 located on a lower portion thereof with corresponding to the first female mold 82. In this present invention, the herein-called 'female mold' is defined as such a mold that has an outer molding surface which a caved structure is caved inwardly from, and is primarily operable to shape outer circumferential surfaces of each of all components of a paper article such as a stick-shaped paper container. and the herein-called 'male mold' is defined as such a mold that has an outer molding surface which a protrusive structure is protruded outwardly from, and is primarily operable to shape inner circumferential surfaces of all components of a paper article as a stick-shaped paper container.

As shown in FIG. 2, the first male mold 84 is disposed with a plurality of spaced-apart first upright posts 85 thereon, which are allocated in a multidimensional-array manner with even distribution, and are protruded outwardly, along a vertical direction, from an upper surface of the first male mold 84. Each of the first upright posts 85 of the first male mold 84 is formed with a longitudinal outermost wall surface substantially rendered as a cylindrical surface, a conical-frustum surface, a truncated-cone surface or a bell-shaped curve surface, but its shape is not therefore limited thereto. The plurality of first upright posts 85 are capable to massively producing the respective components of a stick-shaped paper container 10 (See FIG. 3A) at the same cycle time. In the present invention, each of the first upright posts 85 has a maximum first-upright-post height H2 formed parallel to a corresponding longitudinally mold-matching centre line Y1 but perpendicular to a first-upright-post height H2, wherein a post height-to-width ratio R2 that the maximum first-upright-post height H2 is relative to the maximum first-upright-post width W2 is greater than one (i.e. H2/W2=R2, R2>1). Nevertheless, in another preferred embodiment for the demand on practical production, it can be replaced with other first upright posts 85 having a post height-to-width ratio R2 smaller than one.

Correspondingly, the first female mold 82 as shown in FIG. 2, has a plurality of spaced-apart first vertical pits 822 formed inside a bottom surface of the first female mold 82, with the same spaced intervals thereamong as same as allocated among the plurality of first upright posts 85, such that the plurality of first vertical pits 822 have a deployed arrangement and a sized proportion both respectively corresponding to and being aligned with a deployed arrangement and a sized proportion of the plurality of first upright posts 85. Each of the first vertical pits 822 is formed with a longitudinally inner circumferential wall surface can also be substantially rendered as a cylindrical surface, a conical-frustum surface, a truncated-cone surface or a bell-shaped curve surface.

Furthermore, the entire outermost wall surface of the respective first upright posts 85 of the first male mold 84 and the entire inner circumferential wall surface of the first vertical pits 822 of the first female mold 82 both are respectively formed thereon with a number of micro-pores (not shown) in an evenly-distributing manner. The number of micro-pores are respectively individually liquid-communicated with a vacuum exhausting device, via number of exhausting passages respectively defined inside both the first male mold 84 and the first female mold 82 so as to exhaust moistures and/or their existed inside a pulp (only by way of vacuum exhausting) which is located over the longitudinal outermost wall surface of the respective first upright posts 85.

As depicted in FIG. 2, during a production process, such as the improved wet-fiber pulp-molding process, of the consistently automatic production machines 70 allocated in the production line, at an initial stage the dredging-pulp and pre-compression device 80 makes the first male mold 84 sunk into a slurry tank 86 for storing a slurry (or called 'pulp') 41 that contains a large amount of wet plant fibrous pulps 81; and next, only by way of vacuum exhausting of the vacuum exhausting device via the exhausting passages of the first male mold 84, the wet plant-fibrous pulps 81 are evenly adsorbed into a layer over the entire longitudinal outermost wall surface of the respective first upright post 8 of the first male mold 84. Next, the dredging-pulp and pre-compression device 80 makes the first female mold 82 and the first male mold 84 both being respectively upwardly-and-downwardly moved to be mutually matched with each other and further exerts a slight pressure to pre-compress the wet plant-fibrous pulps 81 located between the first female mold 82 and the first male mold 84, wherein the respective first vertical pits 822 of the first female mold 82 and the corresponding first upright posts 85 of the first male mold 84 both are mutually matched, commonly along the corresponding longitudinally mold-matching centre line Y1, thereby integrally compression-molding the respective component of the stick-shaped paper container 10 (See FIG. 3A); simultaneously, by the vacuum exhausting device implementing the afore-mentioned vacuum exhausting between the first male and female molds 84, 82, a vacuum environment is established therebetween by exhausting out a less portion of water vapor and/or moisture contained in the wet plant-fibrous pulps 81, so as to integrally form a wet paper article 42 (or called 'wet billet'), constructed of the wet plant fibrous pulps 81, between the first female mold 82 and the first male mold 84. In a practical exemplar, a material ingredient of the pulp 81 includes a composition of bamboo pulps and bagasse pulps, but is not limited thereto such a composition ingredient of the wet pulps 81, the working pressure range and a working temperature range of the pulp-dredging and pre-compression device 80, and a moisture content range of the wet paper article 42. This is because depending on different product structures and demands, the composition ingredient and the proportion of the wet pulp 81, the working pressure range and the working temperature range used in the pulp-dredging and pre-compression device 80, and the moisture content range of the wet paper article 42 all might be changed Next, as illustrated in FIG. 2, by the vacuum exhausting device vacuum-suctioning the wet paper article 42 onto an underside of the bottom surface of the first female mold 82, the at least one actuating-to-move apparatus makes the first female mold 82 moved with bringing the adsorbed wet paper article 42 together, to reach between both a second female mold 92 and a second male mold 94 of thermo-compression-molding device 90.

Next, by relieving the vacuum suction, the first female mold 82 releases the wet paper article 42 to be positioned over the second male mold 94 of the thermo-compression-molding device 90. The second female mold 92 and the second male mold 94 of the thermo-compression-molding device 90 have a deployed arrangement and a sized proportion (including size proportions of each of the coupled molds 92, 94) which are similar to a deployed arrangement and a sized proportion of both the first female mold 82 and the first male mold 84 of the dredging-pulp and pre-compression device 80. For example, an upper surface of the second male mold 94 is disposed with a plurality of spaced-apart second upright posts 942 in the same deployed arrangement and the same sized proportion as used in forming the plurality of first upright posts 85 on the first male mold 84, and a plurality of spaced-apart second vertical pits 922 are inwardly formed inside a bottom surface of the second female mold 92, in the same deployed arrangement and the same sized proportion as used in forming the plurality of first vertical pits 822 on the first female mold 82.

Next, as illustrated in FIG. 2, the thermo-compression-molding device 90 makes the second female mold 92 and the second male mold 94 both being respectively upwardly-and-downwardly moved to be mutually matched with each other, and exerts a higher pressure to thermally compress the wet paper article 42 positioned between the second female mold 92 and the second male mold 94; simultaneously, by the way of the vacuum exhausting of the vacuum exhausting device used with both the second female mold 92 and the second male mold 94 of the thermo-compression-molding device 90, a larger portion of water vapor and/or moisture contained in the wet paper article 42 located between the second female mold 92 and the second male mold 94 is exhausted out so as to form a dried paper article 44 constructed of the dried plant fibrous pulps 81.

Next, as illustrated in FIG. 2, the trimming-off device 98 is operable to cut away a few superfluous portions from the dried paper article 44, thereby respectively forming the respective components of the stick-shaped paper container 10 (as a covering body 12 shown in FIG. 3A, which will be detailed later), which is constructed of absolutely-dried plant fibrous pulps 81. In this embodiment, the trimming-off device 98 might be an existing duplicating-to-cut circumferential cutting machine having cutting molds, or any other kinds of trimming-off device.

Figure 3A:
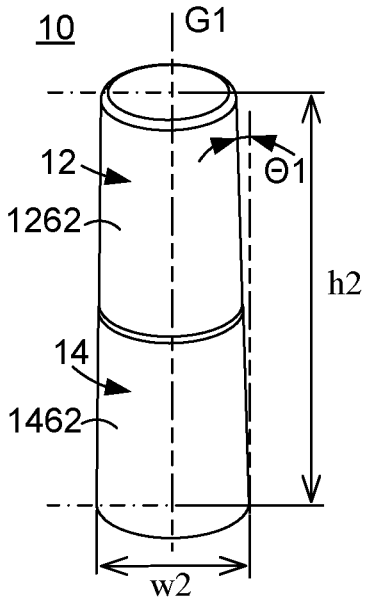
FIG. 3A depicts a perspective diagram of a stick-shaped paper container according to the first preferred embodiment of the present invention.

Please further refer to FIGS. 2 & 3A-3C, wherein FIG. 3A depicts a perspective diagram of the stick-shaped paper container 10 according to a first preferred embodiment of the present invention. The stick-shaped paper container 10 is configured to encapsulation-accommodate a content 100 therein, and primarily comprises the following components: a covering body 12, a sleeving unit 14 and a base seat 16. In this preferred embodiment, the covering body 12, the sleeving unit 14 and the base seat 16 all are integrally molded, respectively, only by preparations of the consistently automatic production machines 70 allocated in the production line used with the improved wet-fiber pulp-molding process, as depicted in FIG. 2. The herein-called 'content' 100 is a main body having a solid-state structure, including but being not limited to, for example cosmetics, lipsticks, 3C electronic products, ornaments, or any thinned-and-elongated appliances/composition for specific function and so forth.

Figure 3B:
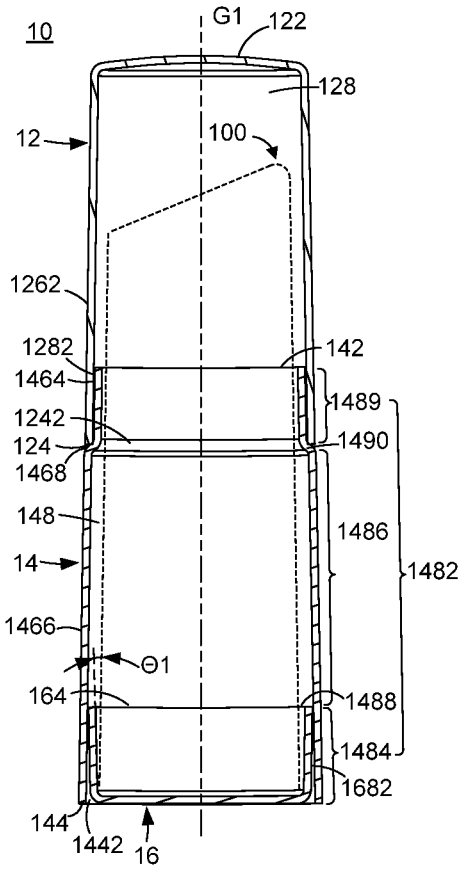
FIG. 3B depicts an enlarged laterally cross-sectional view according to the stick-shaped paper container shown in FIG. 3A.
Figure 3C:
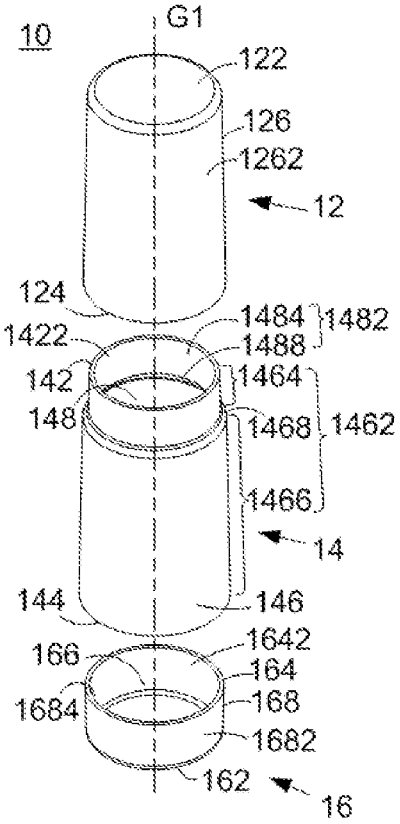
FIG. 3C depicts an exploded view according to the stick-shaped paper container shown in FIG. 3A.

Further referring to FIGS. 3A-3C, the sleeving unit 14 is a single sleeve for tightly sheathing over an outermost wall surface of the content 100 and thereby restricting the content 100 from transversal movement. The sleeving unit 14 is formed with two opposed ends 142, 144 (such as a first end 142 and a second end 144), an annularly standing sleeve wall 146 located between the first and second ends 142, 144 and surrounding a longitudinal centre line G1 (parallel to the longitudinally mold-matching centre line Y1 shown in FIG. 2), and a hollowed sleeve chamber 148 which is formed, along the longitudinal centre line G1, between the first and second ends 142, 144. The first end 142 is formed with a first opening 1422 thereon space-communicated with the hollowed sleeve chamber 148 and provided for the content 100 upwardly passing therethrough. The second end 144 is formed with a second opening 1442 thereon space-communicated with the hollowed sleeve chamber 148 and provided for the content 100 downwardly passing therethrough. The hollowed sleeve chamber 148 configured for accommodating the content 100 therein is formed with an innermost sleeve sidewall 1482 at a position of propping the content 100. The standing sleeve wall 146 has an outermost sleeve sidewall 1462 that is integrally compression-molded, with dependence on a contour of the longitudinally inner circumferential wall surface of the corresponding respective first vertical pit 822 (as shown in FIG. 2), into an outer cylindrical surface or an outer truncated-cone surface but its shape is not therefore limited thereto. Similarly, the innermost sleeve sidewall 1482 of the hollowed sleeve chamber 148 is integrally compression-molded, with dependence on a contour of the longitudinally outermost wall surface of the corresponding respective first upright post 85 (as shown in FIG. 2), into an inner cylindrical surface or an inner truncated-cone surface but its shape is not therefore limited thereto.

Further referring to FIGS. 3A-3C, the outermost sleeve sidewall 1462 is downwardly sequentially divided, from the first end 142 along the longitudinal centre line G1, into a gradually-widened multi-stage portion having different inner diameter per sectioned stage, which comprises an annularly outer narrow-diameter section 1464, an annularly outer wide-diameter section 1466, and a first outer circular saddle 1468 formed on a boundary between the outer narrow-diameter section 1464 and the outer wide-diameter section 1466. An outer diameter of the outer wide-diameter section 1466 is larger than an outer diameter of the outer narrow-diameter section 1464 but substantially equal to an outer diameter of the outer circular saddle 1468. The innermost sleeve sidewall 1482 of the hollowed sleeve chamber 148 is configured to prop up the content 100 and is downwardly divided, from the second end 144 along the longitudinal centre line G1, into a gradually-narrowed multi-stage portion having different inner diameter per sectioned stage, which comprises an annularly-widened inner diameter section 1484, a first annularly-narrowed inner diameter section 1486, a first inner circular saddle 1488 formed on a boundary between the annularly-widened inner diameter 1484 and the first annularly-narrowed inner diameter section 1486, a second annularly-narrowed inner diameter section 1489, and a second inner circular saddle 1490 formed on a boundary between the first annularly-narrowed inner diameter section 1486 and the second annularly-narrowed inner diameter section 1489. An inner diameter of the annularly-widened inner diameter 1484 is larger than an inner diameter of each of the first annularly-narrowed inner diameter section 1486, the second annularly-narrowed inner diameter section 1489, the first inner circular saddle 1488, and the second inner circular saddle 1490, as well as the inner diameter of the first annularly-narrowed inner diameter section 1486 is larger than the inner diameter of the second annularly-narrowed inner diameter section 1489 and the inner diameter of the first inner circular saddle 1488 is larger than the inner diameter of the second inner circular saddle 1490, whereby the second inner circular saddle 1490 and the second annularly-narrowed inner diameter section 1489 both are capable of just transversally supporting and tightly restricting the content 100 on the base seat 16.

Further referring to FIGS. 3A-3C, the covering body 12 has a closed top distal end 122, a fitting-on distal end 124 opposed against the top distal end 122, a standing cover wall 126 formed between the top distal end 122 and the fitting-on distal end 124 and around the longitudinal centre line G1, and a hollowed cover chamber 128 formed, along the longitudinal centre line G1, between the top distal end 122 and the fitting-on distal end 124. The fitting-on distal end 124 is formed with a fitting-on opening 1242 space-communicated with the hollowed cover chamber 128 and is disposed at a position corresponding to the first end 142 of the sleeving unit 14. The hollowed cover chamber 128 is formed with an innermost cover sidewall 1282 therein for propping up the content 100. The standing cover wall 126 has an outermost cover sidewall 1262. Based on the same fabricating principle, the outermost cover sidewall 1262 of the standing cover wall 126 is integrally compression-molded, with dependence on a contour of the longitudinally inner circumferential wall surface of the corresponding respective first vertical pits 822 (as shown in FIG. 2), into an outer cylindrical surface or an outer truncated-cone surface, but its shape is not therefore limited thereto. Similarly, the innermost cover sidewall 1282 of the hollowed cover chamber 128 is integrally compression-molded, with dependence on a contour of the longitudinal outermost wall surface of the corresponding respective first upright post 85 (as shown in FIG. 2), into an inner cylindrical surface or an inner truncated-cone surface, but its shape is not therefore limited thereto.

Further referring to FIGS. 3A-3C, the base seat 16 is configured for longitudinally supporting a bottom side of the content 100, and has a closed bottom terminal 162, an abutting terminal 164 opposed against the bottom terminal 162, a hollowed base chamber 166 formed, along the longitudinal centre line G1, between the bottom terminal 162 and the abutting terminal 164, and a standing base wall 168 formed between the bottom terminal 162 and the abutting terminal 164 and around the longitudinal centre line G1. The abutting terminal 164 is formed with a receiving opening 1642 space-communicated with the hollowed base chamber 166 and is disposed at a position corresponding to the second end 144 of the sleeving unit 14, thereby being capable of encapsulation-accommodating the content 100 in between the covering body 12 and the base seat 16. The standing base wall 168 has an outermost base sidewall 1682. Based on the same fabricating principle, the outermost base sidewall 1682 of the standing base wall 168 is integrally compression-molded, with dependence on a contour of the longitudinally inner circumferential wall surface of the corresponding respective first vertical pit 822 (as shown in FIG. 2), into an outer cylindrical surface or an outer truncated-cone surface, but its shape is not therefore limited thereto. Similarly, the innermost seat sidewall 1684 of the hollowed base chamber 166 is integrally compression-molded, with dependence on a contour of the longitudinal outermost wall surface of the corresponding respective first upright post 85 (as shown in FIG. 2), into an inner cylindrical surface or an inner truncated-cone surface, but its shape is not therefore limited thereto.

Further referring to FIGS. 2 & 3A-3C which depict the first preferred embodiment, the covering body 12, the sleeving unit 14 and the base seat 16 all are individually fabricated only by the consistently automatic production machines 70 (as depicted in FIG. 2), allocated in the production line used with the improved wet-fiber pulp-molding process, where the first male mold 84 is used to dredge up the wet plant-fibrous pulps 81 and then the first male mold 84 and the first female mold 82 both are mutually matched for compression-molding from the wet plant-fibrous pulps 81 into an integral. This leads the respective demold surfaces of the entire structure of each of the covering body 12, the sleeving unit 14 and the base seat 16 to be formed with positive draft angles θ1 (i.e. smaller than or equal to 1.5 degrees) relative to the longitudinal centre line G1 (parallel to the longitudinally mold-matching centre line Y1 depicted in FIG. 2), and to make the outermost cover sidewall 1262, the outermost sleeve sidewall 1462 and the outermost base sidewall 1682 all being formed respectively with flatted surfaces extended toward the same direction.

Further referring to FIGS. 3A-3C, while the fitting-on distal end 124 of the covering body 12 is disposed with the first end 142 of the sleeving unit 14, the first end 142 passes through the fitting-on opening 1242 to enter inside the hollowed cover chamber 128. The innermost cover sidewall 1282 and the outer narrow-diameter section 1464 both are respectively formed with flatted surfaces longitudinally extended in such a way of constituting a plane-to-plane tight contact in a mutually-and-longitudinally resting-on manner (such as a loose fit) between the innermost cover sidewall 1282 and the outer narrow-diameter section 1464. An inner diameter of the fitting-on opening 1242 is equal to the outer diameter of the outer circular saddle 1468 but is smaller than an outer diameter of the outer wide-diameter section 1466, thereby blocking the fitting-on distal end 124 on the outer circular saddle 1468 from moving, and blocking the outer wide-diameter section 1466 of the sleeving unit 14 from continuously entering inside the hollowed cover chamber 128. Preferably, after the covering body 12 and the sleeving unit 14 both are assembled together, the covering body 12 and the sleeving unit 14 both still are respectively rendered in the corresponding positive draft angles θ1 (See FIG. 3A) if the longitudinal centre line G1 is treated as a datum line relative to each position.

Further referring to FIGS. 3A-3C, while the abutting terminal 164 of the base seat 16 is disposed with the second end 144 of the sleeving unit 14, the abutting terminal 164 passes through the second opening 1442 of the sleeving unit 14 to enter inside the hollowed sleeve chamber 148. The annularly-widened inner diameter 1484 and the outermost base sidewall 1682 both are respectively formed with flatted surfaces longitudinally extended in such a way of constituting a plane-to-plane tight contact in a mutually-and-longitudinally resting-on manner between the annularly-widened inner diameter 1484 and the outermost base sidewall 1682 (or adding other permanently retaining structure such as a glue into therebetween). An outer diameter of the abutting terminal 164 is equal to the inner diameter of the first inner circular saddle 1488 but is smaller than the inner diameters of both the first annularly-narrowed inner diameter section 1486 and the fitting-on opening 124 of the covering body 12, thereby blocking the abutting terminal 164 on the first inner circular saddle 1488 from moving to continuously enter inside the first annularly-narrowed inner diameter section 1486. Preferably, the outer diameter of the abutting terminal 164 of the base seat 16 is smaller than the inner diameters of both the second opening 1442 of the sleeving unit 14 and the fitting-on opening 1242 of the covering body 12.

Further referring to FIGS. 3A-3C, after the covering body 12, the sleeving unit 14 and the base seat 16 all are assembled together into the entire stick-shaped paper container 10, the stick-shaped paper container 10 has a maximum container height h2 parallel to the longitudinal centre line G1, a maximum container width w2 perpendicular to the longitudinal centre line G1, and a container height-to-width ratio r2, between 2~5.5 (i.e. $h2/w2=r2$, $5.5 \geq r2 \geq 2$), of the maximum container height h2 being relative to the maximum container width w2. Preferably, while the container height-to-width ratio r2 is between 2~5.5, the maximum container width w2 is between 12~23 mm. Preferably, after the covering body 12, the sleeving unit 14 and the base seat 16 all are assembled together, the base seat 16 is deployed in a reverse-position manner relative to both the covering body 12 and the sleeving unit 14 if the longitudinal centre line G1 is treated as a datum line relative to each position.

Figure 4A:
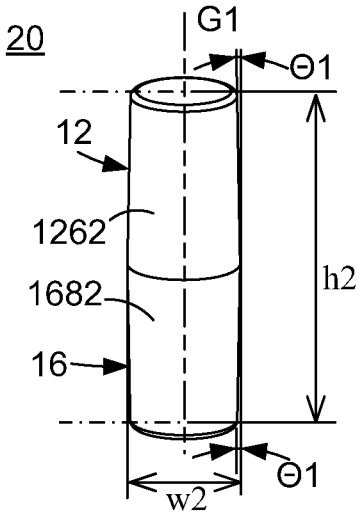
FIG. 4A depicts a perspective diagram of a stick-shaped paper container according to a first preferred embodiment of the present invention.
Figure 4B:
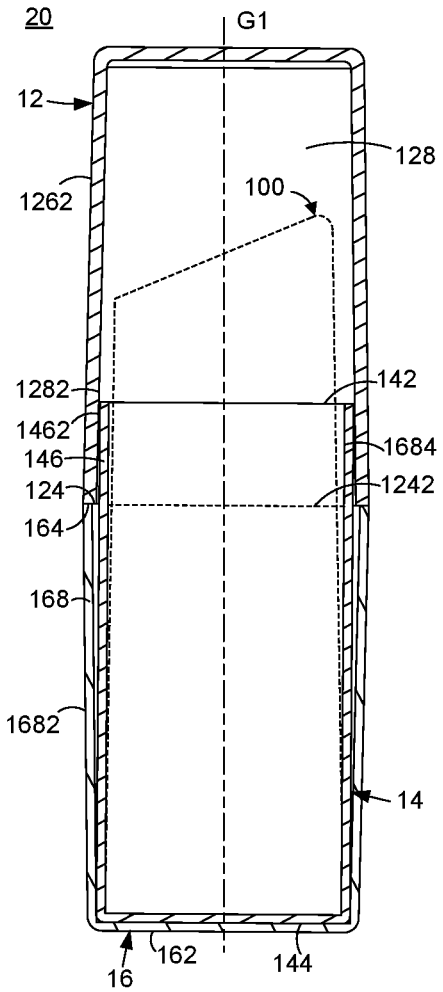
FIG. 4B depicts an enlarged cross-sectional view according to the stick-shaped paper container shown in FIG. 4A.
Figure 4C:
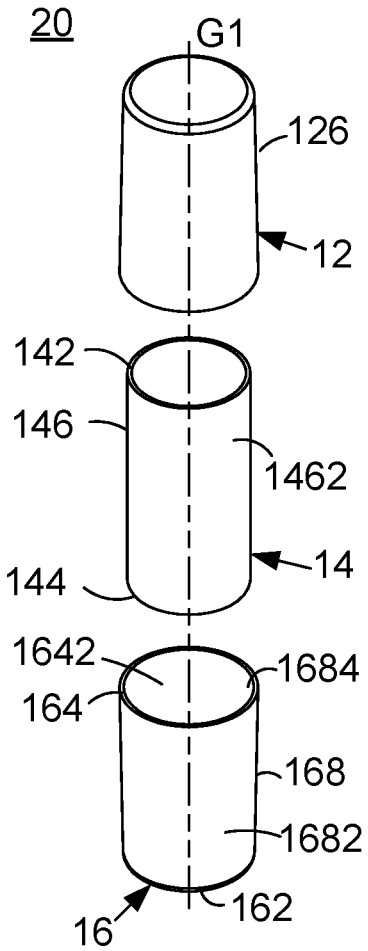
FIG. 4C depicts an exploded view according to the stick-shaped paper container shown in FIG. 4A.

Furthermore, please refer to the illustrations shown in FIGS. 2 & 4A-4C wherein FIG. 4A depicts a perspective diagram of a stick-shaped paper container 20 according to a second preferred embodiment of the present invention. In the second preferred embodiment, the stick-shaped paper container 20 has the similar assembled components, as all above mentioned, comprising a covering body 12, a sleeving unit 14 and a base seat 16. However, the detailed structures and deployed arrangements of each of the covering body 12, the sleeving unit 14 and the base seat 16 in the stick-shaped paper container 20 of the second preferred embodiment shown in FIGS. 4A-4C have the following differences, from the stick-shaped paper container 10 of the first preferred embodiment shown in FIGS. 3A-3C, that:

(1) In the second preferred embodiment depicted in FIGS. 4A-4C, both the covering body 12 and the sleeving unit 14 of the stick-shaped paper container 20 are respectively fabricated, only by the consistently automatic production machines 70 allocated in the production line used with the improved wet-fiber pulp-molding process as depicted in FIG. 2, where the first male mold 84 is used to dredge up the wet plant-fibrous pulps 81 and then the first male mold 84 and the first female mold 82 both are mutually matched for compression-molding from the wet plant-fibrous pulps 81 into an integral. Nevertheless, the base seat 16 can be replaced with using of a typical cylindrical paper tube for lowering its fabricated cost, but is not therefore limited thereto. In another preferred embodiment, the covering body 12, the sleeving unit 14 and the base seat 16 still can be integrally compression-molded, respectively, only by the consistently automatic production machines 70 allocated in the production line used with the improved wet-fiber pulp-molding process, as depicted in FIG. 2;

(2) After integrally compression-molding by the consistently automatic production machines 70 allocated in the production line used with the improved wet-fiber pulp-molding process (as depicted in FIG. 2), the corresponding demold surfaces of the entire structure of each of the covering body 12 and the base seat 16 are formed with positive draft angles θ1 (i.e. smaller than or equal to 1.5 degrees) relative to the longitudinal centre line G1 (parallel to the longitudinally mold-matching centre line Y1 depicted in FIG. 2), thereby making both the outermost cover sidewall 1262 of the covering body 12 and the outermost base sidewall 1682 of the base seat 16 being respectively formed with flatted surfaces extended toward the same direction; nevertheless, after the covering body 12, the sleeving unit 14 and the base seat 16 all are assembled together into the entire stick-shaped paper container 20 as shown in FIG. 4A, the covering body 12 and the base seat 16 both are deployed, in a reverse-position manner relative to each other, as two truncated-cones stacked from up to down.

(3) Further referring to FIGS. 4A-4C which depict the second preferred embodiment, while the abutting terminal 164 of the base seat 16 is disposed with the second end 144 of the sleeving unit 14 (as a closed end for longitudinally supporting the content 100), the second end 144 of the sleeving unit 14 can enter inside the hollowed base chamber 166 of the base seat 16 until the second end 144 of the sleeving unit 14 rests on an inner sidewall of the bottom terminal 162 of the base seat 16 since an inner diameter of the receiving opening 1642 of the abutting terminal 164 of the base seat 16 is larger than an outer diameter of the outermost sleeve sidewall 1462 of the sleeving unit 14. The outermost sleeve sidewall 1462 of the sleeving unit 14 and the innermost seat sidewall 1684 of the base seat 16 both are respectively formed with flatted surfaces longitudinally extended in such a way of constituting a plane-to-plane tight contact in a mutually-and-longitudinally resting-on manner between the outermost sleeve sidewall 1462 and the innermost seat sidewall 1684 (or adding other permanently retaining structure such as a glue into therebetween); and since a height of the standing base wall 168 is smaller than a height of the standing sleeve wall 146, thereby directing the first end 142 of the sleeving unit 14 to position beyond and outside the abutting terminal 164 of the base seat 16;

(4) Further referring to FIGS. 4A-4C which depict the second preferred embodiment, the first end 142 passes through the fitting-on opening 1242 of the covering body 12 to enter inside the hollowed cover chamber 128 while the fitting-on distal end 124 is disposed with the first end 142 of the sleeving unit 14. The innermost cover sidewall 1282 and the outermost sleeve sidewall 1462 both are respectively formed with flatted surfaces longitudinally extended in such a way of constituting a plane-to-plane tight contact (as a loose fit) in a mutually-and-longitudinally resting-on manner between the innermost cover sidewall 1282 and the outermost sleeve sidewall 1462; and an inner diameter of the fitting-on opening 1242 is larger than an outer diameter of the first end 142 but an outer diameter the fitting-on distal end 124 of the covering body 12 is substantially equal to an outer diameter of the abutting terminal 164 of the base seat 16, thereby making the fitting-on distal end 124 of the covering body 12 resting on and being blocked on the abutting terminal 164 of the base seat 16; and (5) Further referring to FIG. 4B, a transversally cross-sectional thickness of the standing cover wall 126 of the covering body 12 is larger than a transversally cross-sectional thickness of each of both the standing base wall 168 and the standing sleeve wall 146, but is not therefore limited thereto. For example, in another preferred embodiment, the covering body 12 and the base seat 16 both can be substantially the same in their entire structures and dimensions.

Except for the afore-mentioned different structures, the other remaining structures of each of the covering body 12, the sleeving unit 14 and the base seat 16 of the stick-shaped paper container 20 according to the second preferred embodiment shown in FIGS. 4A-4C all are substantially the same as the stick-shaped paper container 10 according to the first preferred embodiment shown in FIGS. 3A-3C in both preparations and allocations thereof, and therefore all can be referred to the afore-mentioned introduction for the respective components of the stick-shaped paper container 10 of the first preferred embodiment shown in FIGS. 3A-3C, but will be omitted in detail later. For example, as shown in FIG. 4B, after the covering body 12, the sleeving unit 14 and the base seat 16 all are assembled together into the entire stick-shaped paper container 20, the stick-shaped paper container 20 has a maximum container height h2 parallel to the longitudinal centre line G1, a maximum container width w2 perpendicular to the longitudinal centre line G1 and a container height-to-width ratio r2 of the maximum container height h2 being relative to the maximum container width w2; consistently, the container height-to-width ratio r2 is between 2~5.5 (namely $h2/w2=r2$, $5.5 \geq r2 \geq 2$). Preferably, while the container height-to-width ratio r2 is between 2~5.5, the maximum container width w2 is between 12~23 mm.

Nevertheless, it should be noted that in another embodiment based on an improvement to the second preferred embodiment, the stick-shaped paper container 20 could be assembled with only using both the covering body 12 and the base seat 16 but without the need of using the sleeving unit 14, wherein a lower portion of the content 100 could be permanently retained within the base seat 16 as well as an upper portion of the content 100 is sheathed in an encapsulation manner by the hollowed cover chamber 128 of the covering body 12, thereby constituting a plane-to-plane loose fit in a manner that the innermost cover sidewall 1282 of the covering body 12 directly props up the upper portion of the content 100.

Figure 5A:
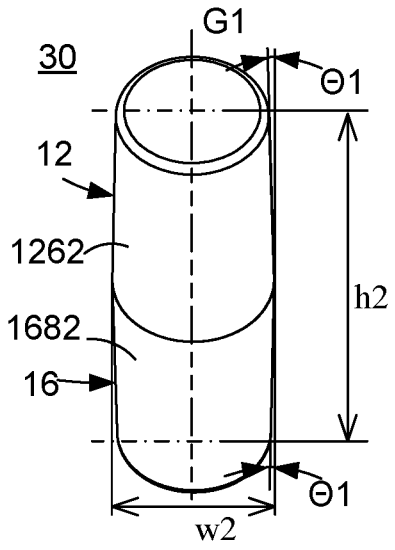
FIG. 5A depicts a perspective diagram of a stick-shaped paper container according to a third preferred embodiment of the present invention.
Figure 5B:
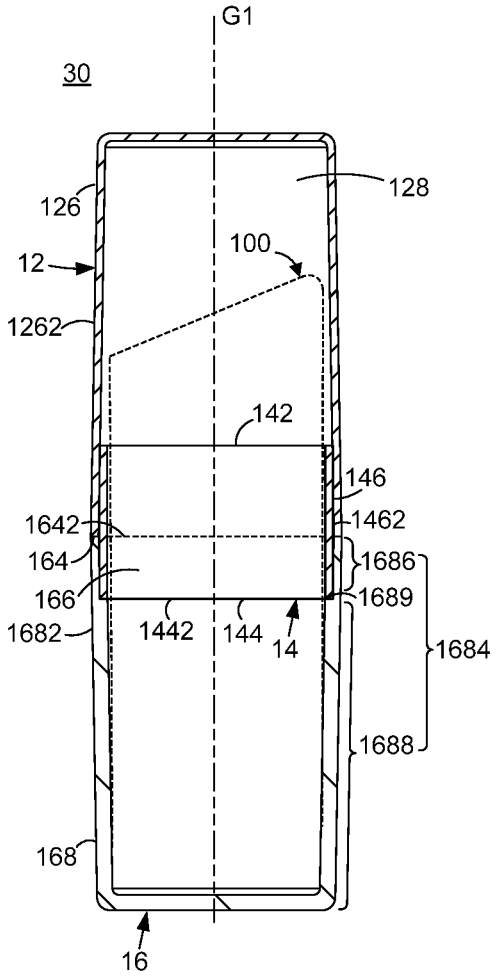
FIG. 5B depicts an enlarged cross-sectional view according to the stick-shaped paper container shown FIG. 5A.
Figure 5C:
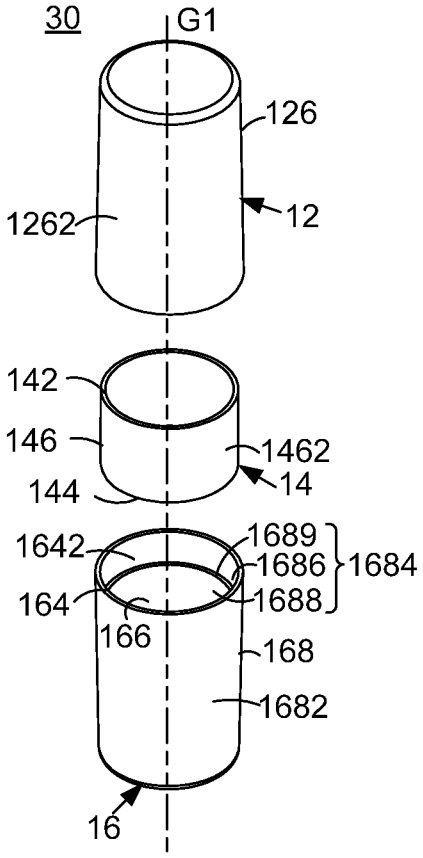
FIG. 5C depicts an exploded view according to the stick-shaped paper container shown FIG. 5A.

Furthermore, please refer to the illustrations shown in FIGS. 5A-5C, wherein FIG. 5A depicts a perspective diagram of the stick-shaped paper container 30 according to a third preferred embodiment of the present invention. In the third preferred embodiment, the stick-shaped paper container 30 has the similar assembled components, as all above mentioned, comprising a covering body 12, a sleeving unit 14 and a base seat 16. Nevertheless, the detailed structure and deployed arrangement of each of the covering body 12, the sleeving unit 14 and the base seat 16 in the stick-shaped paper container 30 according to the third preferred embodiment shown in FIGS. 5A-5C have the following differences, from the stick-shaped paper container 20 according to the second preferred embodiment shown in FIGS. 4A-4C, that:

(1) After integrally compression-molding by the consistently automatic production machines 70 allocated in the production line used with the improved wet-fiber pulp-molding process (as depicted in FIG. 2), the corresponding demold surfaces of the respective entire structure of both the covering body 12 and the base seat 16 are formed with positive draft angles θ1 (i.e. smaller than or equal to 1.5 degrees) relative to the longitudinal centre line G1 (parallel to the longitudinally mold-matching centre line Y1 depicted in FIG. 2), and whereby both the outermost cover sidewall 1262 of the covering body 12 and the outermost base sidewall 1682 of the base seat 16 are respectively formed with flatted surfaces extended toward the same direction. After the covering body 12, the sleeving unit 14 and the base seat 16 all are assembled together into the entire stick-shaped paper container 30 shown in FIG. 4A, the covering body 12 and the base seat 16 both are disposed in a reverse-position manner with relative to each other and are rendered as two truncated-cones stacked from up to down;

(2) Referring to FIGS. 5A-5C which depict the third preferred embodiment, the innermost seat sidewall 1684 of the base seat 16 is divided downwardly, from the abutting terminal 164 along the longitudinal centre line G1, into an annularly-widened inner diameter section 1686, an annularly-narrowed inner diameter section 1688, and an inner circular saddle 1689 formed on a boundary between the annularly-widened inner diameter section 1686 and the annularly-narrowed inner diameter section 1688. After the abutting terminal 164 of the base seat 16 is disposed with the second end 144 of the sleeving unit 14 (which has a second opening 1442 provided for the content 100 longitudinally passing through), an inner diameter of the receiving opening 1642 of the abutting terminal 164 of the base seat 16 is larger than an outer diameter of the outermost sleeve sidewall 1462 of the sleeving unit 14 such that the second end 144 of the sleeving unit 14 can pass through the receiving opening 1642 of the base seat 16 to enter inside the hollowed base chamber 166 of the base seat 16 until the second end 144 is blocked on the inner circular saddle 1689 from moving to continuously enter inside the annularly-narrowed inner diameter section 1688 since an outer diameter the second end 144 of the sleeving unit 14 is larger than an inner diameter of the annularly-narrowed inner diameter section 1688 but is equal to an inner diameter of the inner circular saddle 1689 of the base seat 16. Simultaneously, both the annularly-widened inner diameter section 1686 of the base seat 16 and the outermost sleeve sidewall 1462 of the sleeving unit 14 are respectively formed with flatted surfaces longitudinally extended in such a way of constituting a plane-to-plane tight contact in a mutually resting-on manner between the annularly-widened inner diameter section 1686 and the outermost sleeve sidewall 1462 (or adding other permanently retaining structure such as a glue into therebetween). A height of the standing base wall 168 is smaller than a height of the standing sleeve wall 146, whereby the first end 142 of the sleeving unit 14 can be positioned beyond and outside the abutting terminal 164 of the base seat 16, in a fitting-on manner between the covering body 12 and the sleeving unit 14, wherein the first end 142 and an upper portion of the content 100 both are totally sheathed by the hollowed cover chamber 128; and (3) Further referring to FIG. 5B, a transversally cross-sectional thickness of the standing cover wall 126 of the covering body 12 is substantially equal to an transversally cross-sectional thickness of the annularly-widened inner diameter section 1686 of the standing base wall 168, but the transversally cross-sectional thickness of the annularly-narrowed inner diameter section 1688 of the standing base wall 168 is larger than the transversally cross-sectional thickness of each of both the standing sleeve wall 146 and the standing cover wall 126.

Except for the afore-mentioned different structures, the other respective remaining structures of each of the covering body 12, the sleeving unit 14 and the base seat 16 of the stick-shaped paper container 30 according to the third preferred embodiment shown in FIGS. 5A-5C are substantially the same as the stick-shaped paper container 20 according to the second preferred embodiment shown in FIGS. 3A-3C in both preparations and allocations thereof, and therefore all can be referred to the afore-mentioned introductions for the respective components of the stick-shaped paper container 20 according to the second preferred embodiment shown in FIGS. 4A-4C, but therefore will be omitted in detail later. For example, as shown in FIG. 5B, after the covering body 12, the sleeving unit 14 and the base seat 16 all are assembled together into the entire stick-shaped paper container 30, the stick-shaped paper container 30 has a maximum container height h2 parallel to the longitudinal centre line G1, a maximum container width w2 perpendicular to the longitudinal centre line G1 and a container height-to-width ratio r2 of the maximum container height h2 being relative to the maximum container width w2; consistently, the container height-to-width ratio r2 is between 2~5.5 (namely $h2/w2=r2$, $5.5 \geq r2 \geq 2$). Preferably, while the container height-to-width ratio r2 is between 2~5.5, the maximum container width w2 is between 12~23 mm.

Nevertheless, it should be noted that in another embodiment based on an improvement to the third preferred embodiment, the stick-shaped paper container 30 could be assembled with usage of only both the covering body 12 and the base seat 16 but without the need of using the sleeving unit 14, and the covering body 12 and the base seat 16 both are substantially the same in their entire structure and dimension, wherein a lower portion of the content 100 could be permanently retained within the base seat 16 as well as an upper portion of the content 100 is sheathed in an encapsulation manner by the covering body 12, and thereby constituting a plane-to-plane loose fit in a manner that the innermost cover sidewall 1282 of the covering body 12 directly props up the upper portion of the content 100.

Figure 6A:
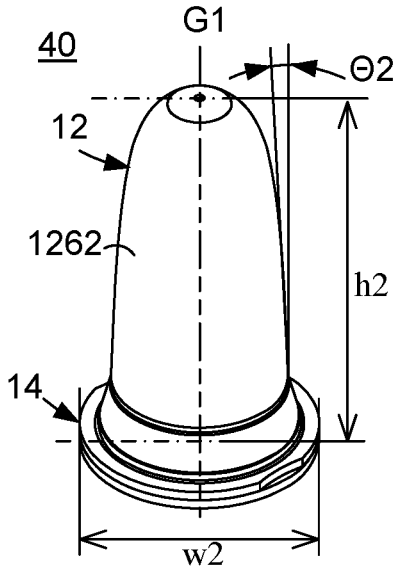
FIG. 6A depicts a perspective diagram of a stick-shaped paper container according to a fourth preferred embodiment of the present invention.
Figure 6B:
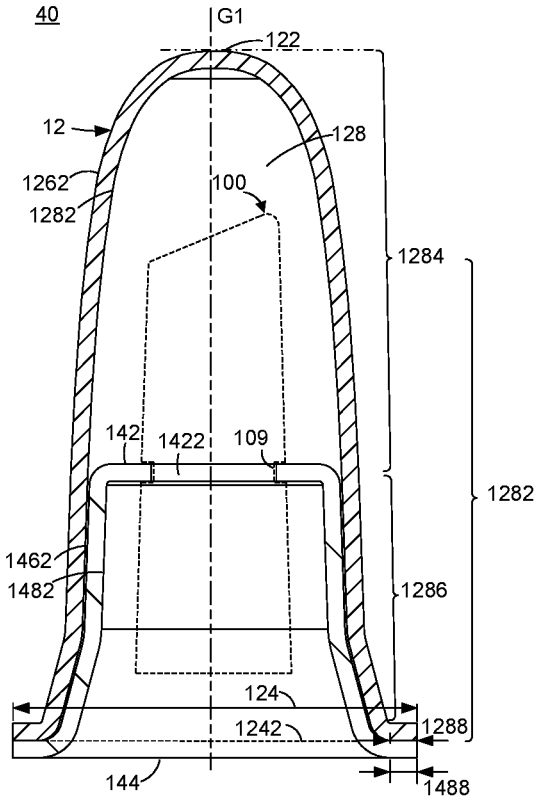
FIG. 6B depicts an enlarged cross-sectional view according to the stick-shaped paper container shown in FIG. 6A.
Figure 6C:
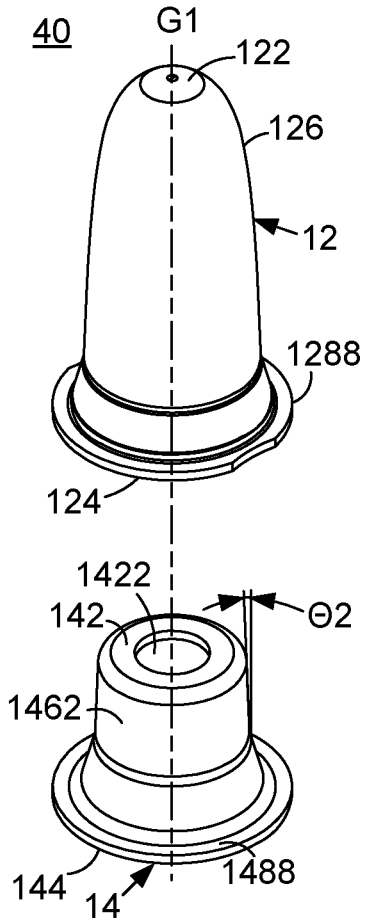
FIG. 6C depicts an exploded view according to the stick-shaped paper container shown in FIG. 6A.

Furthermore, please refer to the illustrations shown in FIGS. 2 & 6A-6C. FIG. 6A depicts a perspective diagram of a stick-shaped paper container 40 according to a fourth preferred embodiment of the present invention. In the fourth preferred embodiment, the stick-shaped paper container 40 has the assembled components which comprises only both a covering body 12 and a sleeving unit 14. However, the detailed structure and deployed arrangement of each of the covering body 12 and the sleeving unit 14 of the stick-shaped paper container 40 according to the fourth preferred embodiment shown in FIGS. 6A-6C have the following differences, from the covering body 12 and the sleeving unit 14 of the stick-shaped paper container 30 according to the third preferred embodiment shown in FIGS. 5A-5C, that:

(1) Referring to FIGS. 6A-6C which depict the fourth preferred embodiment, the stick-shaped paper container 40 are assembled into with use of only both the covering body 12 and the sleeving unit 14 but without the need of using the base seat 16 depicted in FIG. 5A. Accordingly, an intermediate portion of the content 100 (such as a recess 109) can be permanently retained in snap-fit by a circumferential wedge formed on the first opening 1422 of the first end 142 of the sleeving unit 14, for restricting the content 100 from movements toward different multi-directions, as well as an upper portion of the content 100 can upwardly pass through the first opening 1422 to be sheathed in an encapsulation manner by the hollowed cover chamber 128 of the covering body 12;

(2) Further referring to FIGS. 2 & 6A-6C which depict the fourth preferred embodiment, the covering body 12 and the sleeving unit 14 both are respectively fabricated, only by the consistently automatic production machines 70 allocated in the production line used with the improved wet-fiber pulp-molding process (as depicted in FIG. 2) where the first male mold 84 is used to dredge up the wet plant-fibrous pulps 81 and then the first male mold 84 and the first female mold 82 both are mutually matched for compression-molding from the wet plant-fibrous pulps into an integral. This leads the corresponding demold surfaces of the respective entire structure of both the covering body 12 and the sleeving unit 14 to be formed with positive draft angles θ2 (i.e. smaller than or equal to 2 degrees) relative to the longitudinal centre line G1 (parallel to the longitudinally mold-matching centre line Y1 depicted in FIG. 2). Both the outermost cover sidewall 1262 of the covering body 12 and the outermost sleeve sidewall 1462 of the sleeving unit 14 both are respectively formed with smoothly curved surfaces which are outwardly extended in the same oblique angle, to terminate in both the fitting-on distal end 124 and the second end 144. In the fourth preferred embodiment, after integrally compression-molding used with the wet-fiber pulp-molding process, the outermost cover sidewall 1262 and its corresponding innermost cover sidewall 1282 both are respectively formed with a conical-frustum surface, and the outermost sleeve sidewall 1462 and its corresponding innermost sleeve sidewall 1482 both are formed with a truncated-cone surface, but their shapes are not therefore limited thereto;

(3) Further referring to FIGS. 6A-6C which depict the fourth preferred embodiment, after the covering body 12 and the sleeving unit 14 both are assembled together, the covering body 12 and the sleeving unit 14 both can still be respectively rendered in the corresponding positive draft angles θ2 if the longitudinal centre line G1 is treated as a datum line relative to each position. Accordingly, the sleeving unit 14 can be totally accommodated/nested inside the hollowed cover chamber 128 of the covering body 12; and (4) Referring to FIGS. 6A-6C which depict the fourth preferred embodiment, the innermost cover sidewall 1282 is downwardly divided, from the top distal end 122 along the longitudinal centre line G1, into an annularly-narrowed inner diameter section 1284 having a conical surface, an annularly-widened inner diameter section 1286, and a first outer circular saddle 1288 formed between an end of the annularly-widened inner diameter section 1286 and the fitting-on distal end 124. The first outer circular saddle 1288 is used as a transversally-extended stopper. The outermost sleeve sidewall 1462 of the sleeving unit 14 is formed with a smoothly curved surface outwardly extended and has a second outer circular saddle 1488 treated as a transversally-extended stopper.

While the fitting-on distal end 124 of the covering body 12 is disposed with the second end 144 of the sleeving unit 14, the first end 142 of the sleeving unit 12 passes through the fitting-on opening 1242 to enter inside the hollowed cover chamber 128, wherein the smoothly curved surfaces of both the annularly-widened inner diameter section 1286 and the outermost sleeve sidewall 1462 are respectively extended outwardly in the same oblique to terminate in the first and second outer circular saddles 1288, 1488 both which are transversally extended in such a way of constituting a plane-to-plane tight contact (i.e. a loose fit) in a mutually resting-on manner between the annularly-widened inner diameter section 1286 and the outermost sleeve sidewall 1462 (containing the first and second outer circular saddles 1288, 1488), and an outer diameter of the second end 144 is larger than an inner diameter of the fitting-on opening 1242, both the second end 144 and the second outer circular saddle 1488 can be blocked on a bottom side of the first outer circular saddle 1288 from inwardly moving, namely the bottom side of the first outer circular saddle 1288 will longitudinally rest on the second outer circular saddle 1488.

Except for the afore-mentioned different structures, the other respective remaining structures of each of the covering body 12 and the sleeving unit 14 of the stick-shaped paper container 40 according to the fourth preferred embodiment shown in FIGS. 6A-6C are substantially the same as the stick-shaped paper container 30 according to the third preferred embodiment shown in FIGS. 5A-5C, and all can be referred to the afore-mentioned introductions for the respective components of the stick-shaped paper container 30 according to the third preferred embodiment shown in FIGS. 5A-5C, but will be omitted in detail later. For example, as shown in FIG. 6B, when only both the covering body 12 and the sleeving unit 14 are assembled together into the entire stick-shaped paper container 40, the stick-shaped paper container 40 has a maximum container height h2 parallel to the longitudinal centre line G1, a maximum container width w2 perpendicular to the longitudinal centre line G1, and a container height-to-width ratio r2 of the maximum container height h2 being relative to the maximum container width w2, wherein the container height-to-width ratio r2 is between 2~3.5 (namely $h2/w2=r2$, $3.5 \geq r2 \geq 2$). Preferably, while the container height-to-width ratio r2 is between 2~3.5, the maximum container width w2 is between 12~23 mm.

Figure 7A:
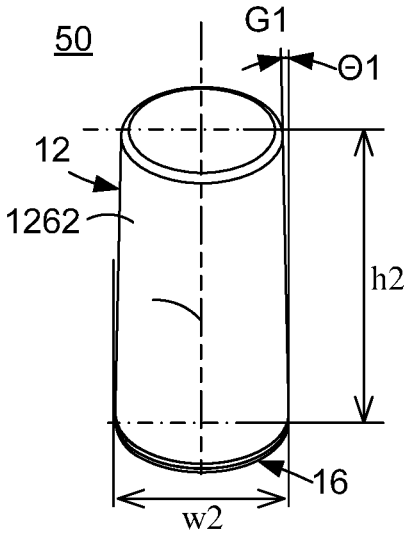
FIG. 7A depicts a perspective diagram of a stick-shaped paper container 30 according to a fifth preferred embodiment of the present invention.

Furthermore, please refer to the illustrations shown in FIGS. 7A-7D, wherein FIG. 7A depicts a perspective diagram of a stick-shaped paper container 50 according to a fifth preferred embodiment of the present invention. The stick-shaped paper container 50 according to the fifth preferred embodiment has the similar assembled components, as afore-mentioned, comprising a covering body 12, a sleeving unit 14 and a base seat 16. Nevertheless, the detailed structure and deployed arrangement of each of the covering body 12, the sleeving unit 14 and the base seat 16 of the stick-shaped paper container 50 according to the fifth preferred embodiment shown in FIGS. 7A-7D has the following differences, from the stick-shaped paper container 10 of the first preferred embodiment shown in FIGS. 3A-3C, that:

(1) Referring to FIGS. 7A-7D which depict the fifth preferred embodiment, the sleeving unit 14 comprises an inner and outer sleeve 14', 14" both of which are nested/stacked together, along the longitudinal centre line G1, to be assembled into the sleeving unit 14. The inner and outer sleeves 14', 14" are respectively formed with two outermost sleeve sidewalls 1462', 1462" both having flatted surfaces longitudinally extended, thereby tightly assembling the inner and outer sleeves 14', 14" together by way of an interlocking retention between a couple of interlocking components 147', 147" respectively formed on the inner and outer sleeves 14', 14". The outermost sleeve sidewall 1462' of the inner sleeve 14' has an end from which an outer circular saddle 1488' is transversally and outwardly extended to terminate in a second end 144'. In the embodiment, the interlocking component 147' of the inner sleeve 14' is a ">"-shaped grooved structure formed along a curve surface of the standing sleeve wall 146'. The interlocking component 147" of the outer sleeve 14" is a hook structure inwardly protruded from the standing sleeve wall 146". While the inner and outer sleeves 14', 14" are nested together in assembly, a first end 142' of the inner sleeve 14' enters inside the hollowed sleeve chamber 148" of the outer sleeve 14" to position the hook structure 147" inside the ">"-shaped grooved structure 147' at a starting end thereof; and next, the outer sleeve 14" can be rotated, in a specific degree relative to the longitudinal centre line G1 (as a center axis) of the inner sleeve 14', to direct the hook structure 147' at rotatably moving from up to down by resting on along an extending passageway of the ">"-shaped grooved structure 147". Finally, the interlocking retention between the coupled interlocking components 147', 147" can be established in such a way of constituting a plane-to-plane tight contact (i.e. a loose fit) in a mutually-and-longitudinally resting-on manner between the outermost sleeve sidewall 1462' of the inner sleeve 14' and the innermost sleeve sidewall 1482" of the outer sleeve 14", whereby the second end 144" of the outer sleeve 14" is blocked and rests on a top side of the outer circular saddle 1488' of the outer sleeve 14'. In another preferred embodiment, the sleeving unit 14 can also be assembled with more than two sleeves. The first ends 142', 142" of the inner and outer sleeves 14', 14" are respectively formed with two first openings 1422', 1422" such that after the inner and outer sleeves 14', 14" are nested in assembly, the first openings 1422', 1422" provided for the content 100 passing therethrough have respective centre points collinear on the longitudinal centre line G1, whereby the respective circumferential wedges of the first openings 1422', 1422" can restrict the content 100 from transversal movement;

(2) Referring to FIGS. 2 & 7A-7D which depict the fifth preferred embodiment, the covering body 12, the inner and outer sleeves 14', 14" (as the sleeving unit 14), and the base seat 16 of the stick-shaped paper container 50 all are integrally molded, respectively, only by way of the preparations of the consistently automatic production machines 70 allocated in the production line used with the improved wet-fiber pulp-molding process (as depicted in FIG. 2) where the first male mold 84 is used to dredge up the wet plant-fibrous pulps 81 and then the first male mold 84 and the first female mold 82 both are mutually matched for compression-molding from the wet plant-fibrous pulps 81 into an integral. After integrally compression-molding, all corresponding demold surfaces of the respective entire structure of the covering body 12, the inner and outer sleeves 14', 14" and the base seat 16 are formed with positive draft angles θ1 (i.e. smaller than or equal to 1.5 degrees) relative to the longitudinal centre line G1 (parallel to the longitudinally mold-matching centre line Y1 depicted in FIG. 2), and the outermost cover sidewall 1262 of the covering body 12, the two outermost sleeve sidewalls 1462', 1462" of the sleeving unit 14, and the outermost base sidewall 1682 of the base seat 16 all have flatted surfaces longitudinally extended. Preferably, after the integrally compression-molding, the corresponding standing sleeve wall 146', 146" of the inner and outer sleeves 14', 14" are respectively machined by a punching or extrusion process, so as to form the coupled interlocking components 147', 147" thereon, rather than being integrally compression-molded with such coupled interlocking components 147', 147" both rendered in negative draft angles.

(3) Referring to FIGS. 7A-7D which depict the fifth preferred embodiment, the outermost base sidewall 1682 of the base seat 16 is formed with a flatted surface longitudinally extended to reach at an end from which an outer circular saddle 1683 is further transversally and outwardly extended to terminate in a bottom terminal 162. The outer circular saddle 1683 is as a transversally-extended stopper. While the abutting terminal 164 of the base seat 16 is disposed with the second end 144 of the sleeving unit 14', the abutting terminal 164 passes through the second opening 1442 of the sleeving unit 14' to enter inside the hollowed sleeve chamber 148'. The innermost sleeve sidewall 1482' of the inner sleeve 14' and the outermost base sidewall 1682 both are respectively formed with flatted surfaces longitudinally extended, thereby being capable of constituting a plane-to-plane tight contact in a mutually-and-longitudinally resting-on manner between the innermost sleeve sidewall 1482' and the outermost base sidewall 1684 (or adding other permanently retaining structure such as a glue into therebetween). An outer diameter of the abutting terminal 164 is smaller than an inner diameter of each of both the second opening 1442' and the fitting-on opening 1242 such that the abutting terminal 164 can enter inside the hollowed sleeve chamber 148'; however, an outer diameter of the bottom terminal 162 of the base seat 16 is larger than the inner diameter of each of both the second opening 1442' and the fitting-on opening 1242, such that the bottom terminal 162 and the outer circular saddle 1683 both can be blocked on a bottom side of the outer circular saddle 1488' from moving to continuously enter inside the hollowed sleeve chamber 148', and the bottom side of the outer circular saddle 1488' can rest over the outer circular saddle 1683;

(4) Referring to FIGS. 7A-7D which depicts the fifth preferred embodiment, while the fitting-on distal end 124 of the covering body 12 is disposed over the sleeving unit 14, the first end 142 of the sleeving unit 14" passes through the fitting-on opening 1242 of the covering body 12 to enter inside the hollowed cover chamber 128, wherein the innermost cover sidewall 1282 of the covering body 12 and the outermost sleeve sidewall 1462 of the sleeving unit 14" both are respectively formed with flatted surfaces longitudinally extended in such a way of constituting a plane-to-plane tight contact (i.e. a loose fit) in a mutually-and-longitudinally resting-on manner between the innermost cover sidewall 1282 and the outermost sleeve sidewall 1462". The inner diameter of the fitting-on opening 1242 is larger than an outer diameter of the outermost sleeve sidewall 1462" such that the entire outermost sleeve sidewall 1462" of the sleeving unit 14 can enter inside the hollowed cover chamber 128 until the fitting-on distal end 124 of the covering body 12 is blocked on or rest on a top side of the outer circular saddle 1488'; and (5) Referring to FIGS. 7A-7D which depict the fifth preferred embodiment, after the covering body 12, the sleeving unit 14 and the base seat 16 all are assembled together into the entire stick-shaped paper container 50, the covering body 12, the sleeving unit 14 and the base seat 16 all still are respectively rendered in the corresponding positive draft angles θ1 if the longitudinal centre line G1 is treated as a datum line relative to each position; and, the sleeving unit 14 and the base seat 16 both can be accommodated/nested within the hollowed cover chamber 128 of the covering body 12. Similarly, the stick-shaped paper container 50 has a maximum container height h2 parallel to the longitudinal centre line G1, a maximum container width w2 perpendicular to the longitudinal centre line G1 and a container height-to-width ratio r2 of the maximum container height h2 being relative to the maximum container width w2; and consistently, the container height-to-width ratio r2 is between 2~3.5 (namely h2/w2=r2, 5.5≥r2≥2). Preferably, while the container height-to-width ratio r2 is between 2~3.5, the maximum container width w2 is between 12~23 mm.

Figure 7B:
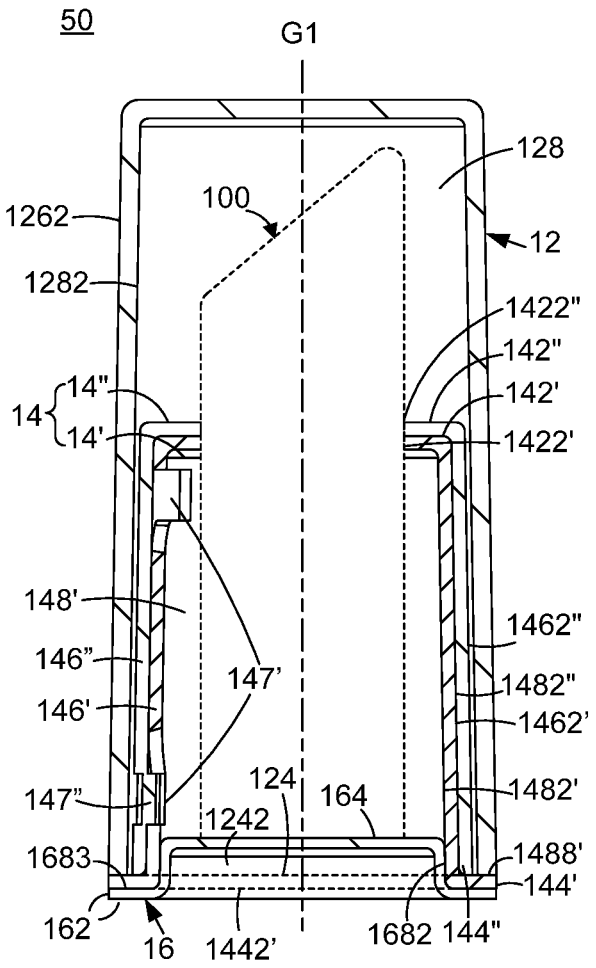
FIG. 7B depicts an enlarged cross-sectional view according to the stick-shaped paper container shown in FIG. 7A.
Figure 7C:
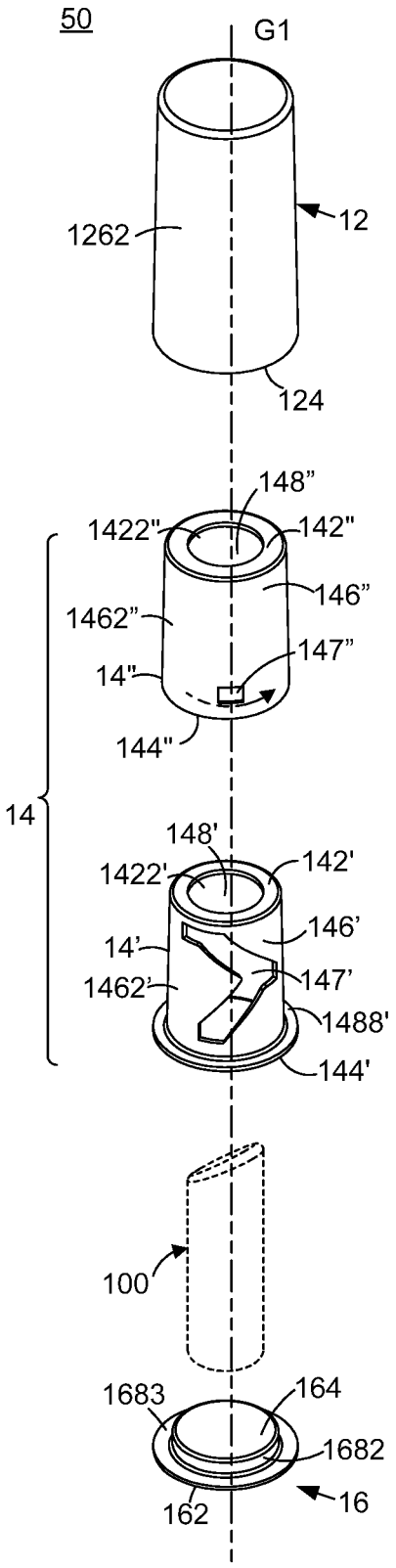
FIG. 7C depicts an exploded view according to the stick-shaped paper container shown in FIG. 7A.
Figure 7D:
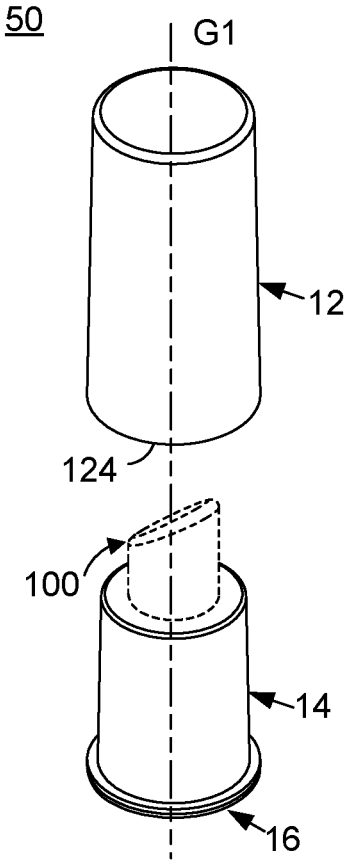
FIG. 7D depicts a partially assembled view according to the stick-shaped paper container shown in FIG. 7A.

Except for the afore-mentioned different structures, the other respective remaining structures of the covering body 12, the sleeving unit 14 and the base seat 16 of the stick-shaped paper container 50 of the fifth preferred embodiment shown in FIGS. 7A-7C all are substantially the same as the stick-shaped paper container 10 of the first preferred embodiment shown in FIGS. 3A-3C in their preparation and allocations, and all can be referred to the afore-mentioned introductions for the respective components of the stick-shaped paper container 10 of the first preferred embodiment shown in FIGS. 3A-3C, but therefore will be omitted in detail later.

Nevertheless, in another preferred embodiment, the respective transversally cross-sectional thicknesses of all the covering body 12, the two inner and outer sleeves 14', 14" and the base seat 16 are different from each other. It should be noted that, for another embodiment on a basis of an improvement to the fifth preferred embodiment, the stick-shaped paper container 50 can be assembled with the use of only both the covering body 12 and the sleeving unit 14, but without the need of using the base seat 16, such that an intermediate portion of or a lower portion of the content 100 can be permanently retained within the first openings 1422', 1422" of the sleeving unit 14, and an upper portion of the content 100 can be sheathed, in an encapsulation manner, within the hollowed cover chamber 128 of the covering body 12.

Compared with the conventional arts, each of all the components of the stick-shaped paper container 10, 20, 30, 40, 50, according to the present invention, is capable of being integrally molded by way of the preparations of the consistently automatic production machines 70 allocated in the production line used with the improved wet-fiber pulp-molding process (as depicted in FIG. 2). This does not only resolve said technical drawback of the conventional pulp-molding process which is incapable of producing such a paper article having a height-to-width ratio, greater than one, of its maximum longitudinal height being relative to its maximum transversal width, but also reduces its working cycle time, benefits its mass production, and assures its higher product yield and quality. Furthermore, during a compression-molding used with the wet-fiber pulp-molding process, the respective demold surfaces of all the components of the stick-shaped paper containers 10, 20, 30, 40, 50 according to the present invention all are rendered in the corresponding positive draft angles relative to the longitudinal demolding direction Y1 (See FIG. 2) in the series of mold assemblies 82, 84, 92, 94, rather than the negative draft angles as rendered in the respective demold surfaces of the laterally latch structure and/or laterally recessed structure of the conventional pulp-molded article. Consequently, it is unnecessary to additionally dispose any other transversal mold implemented for horizontally demolding, and/or a slidable block device implemented for horizontal movement, along with collocating the mold assemblies for vertically demolding, and thereby being capable of simplifying the mold assemblies, and lowering its mold cost.

As described above, although the present invention has been described with the preferred embodiments thereof, those skilled in the art will appreciate that various modifications, additions, and substitutions are possible without departing from the scope and the spirit of the invention. Accordingly, the scope of the present invention is intended to be defined only by reference to the claims.

What is claimed is:

1. A stick-shaped paper container, configured for accommodating a content therein, comprising:

a sleeving unit, configured for restricting the content from transversal movement, having a first and second end both opposed against each other, an annularly standing sleeve wall located between the first and second ends and formed around a longitudinal centre line, and a hollowed sleeve chamber formed, along the longitudinal centre line, between the first and second ends, wherein the first end is formed with a first opening space-communicated with the hollowed sleeve chamber and provided for the content passing therethrough, the hollowed sleeve chamber is formed with an innermost sleeve sidewall in a position of propping the content, and the standing sleeve wall is formed with an outermost sleeve sidewall;

a covering body, having a closed top distal end, a fitting-on distal end opposed against the top distal end, a standing cover wall located between the top distal end and the fitting-on distal end and formed around the longitudinal centre line, and a hollowed cover chamber formed, along the longitudinal centre line, between the top distal end and the fitting-on distal end, wherein the fitting-on distal end is formed with a fitting-on opening space-communicated with the hollowed cover chamber, the hollowed cover chamber is formed with an innermost cover sidewall therein, the covering body is disposed with the first end of the sleeving unit, and the standing cover wall has an outermost cover sidewall; and a base seat, configured for longitudinally supporting the content, having a closed bottom terminal, an abutting terminal opposed against the bottom terminal, a hollowed base chamber formed, along the longitudinal centre line, between the bottom terminal and the abutting terminal, and a standing base wall located between the bottom terminal and the abutting terminal and formed around the longitudinal centre line, wherein the abutting terminal is formed with a receiving opening space-communicated with the hollowed base chamber, and is disposed at a position corresponding to the second end of the sleeving unit, in such a way of accommodating the content within between both the covering body and the base seat, and the standing base wall has an outermost base sidewall; and wherein the covering body and the base seat both are integrally formed, respectively, only by a wet-fiber pulp-molding process where a male mold is used to dredge up wet plant-fibrous pulps, and then the male mold and a female mold both compression-mold the wet plant-fibrous pulps, in such a way that the entire structure of each of the covering body and the base seat is formed with positive draft angles relative to the longitudinal centre line, wherein the covering body, the sleeving unit and the base seat are assembled together into the entire stick-shaped paper container which has a maximum container height parallel to the longitudinal centre line, a maximum container width perpendicular to the longitudinal centre line, and a container height-to-width ratio, between 2~5.5, of the maximum container height being relative to the maximum container width.

2. The stick-shaped paper container according to claim 1, wherein the sleeving unit is integrally formed by the wet-fiber pulp-molding process where the male mold dredges up the wet plant-fibrous pulps and then the male mold and the female mold both compression-mold the wet plant-fibrous pulps, in such a way that the entire structure of the sleeving unit is formed with positive draft angles relative to the longitudinal centre line.

3. The stick-shaped paper container according to claim 2, wherein the outermost sleeve sidewall is divided, by along the longitudinal centre line, into an annularly outer narrow-diameter section, an annularly outer wide-diameter section, and an outer circular saddle formed on a boundary between the outer narrow-diameter section and the outer wide-diameter section, wherein the first end passes through the fitting-on opening to enter inside the hollowed cover chamber while the fitting-on distal end is disposed with the first end, and the innermost cover sidewall and the outer narrow-diameter section both are respectively formed with flatted surfaces longitudinally extended in such a way of constituting a plane-to-plane tight contact in a mutually resting-on manner between the innermost cover sidewall and the outer narrow-diameter section, and an inner diameter of the fitting-on opening is smaller than an outer diameter of the outer circular saddle, thereby blocking the fitting-on distal end on the outer circular saddle from moving.

4. The stick-shaped paper container according to claim 2, wherein the second end of the sleeving unit is formed with a second opening space-communicated with the hollowed sleeve chamber, and the innermost sleeve sidewall is divided, by along the longitudinal centre line, into an annularly-narrowed inner diameter section, an annularly-widened inner diameter section, and an inner circular saddle formed on a boundary between both the annularly-narrowed inner diameter section and the annularly-widened inner diameter, wherein the abutting terminal passes through the second opening of the sleeving unit to enter inside the hollowed sleeve chamber while the abutting terminal is disposed with the second end, the annularly-widened inner diameter section and the outermost base sidewall both have flatted surfaces extended toward the same direction in such a way of constituting a plane-to-plane tight contact in a mutually resting-on manner between the annularly-widened inner diameter section and the outermost base sidewall, and an outer diameter of the abutting terminal is smaller than an inner diameter of the inner circular saddle and is smaller than the inner diameter of the fitting-on opening of the covering body, thereby blocking the abutting terminal on the inner circular saddle from moving.

5. The stick-shaped paper container according to claim 4, wherein an outer diameter of the abutting terminal of the base seat is smaller than an inner diameter of each of both the second opening of the sleeving unit and the fitting-on opening of the covering body.

6. The stick-shaped paper container according to claim 2, wherein after the covering body and the sleeving unit both are assembled together, the covering body and the sleeving unit both are respectively positioned with the corresponding positive draft angles relative to the longitudinal centre line.

7. The stick-shaped paper container according to claim 1, wherein the sleeving unit is constituted by assembling at least two sleeves in a nested or stacked manner along the longitudinal centre line.

8. The stick-shaped paper container according to claim 7, wherein while the at least two sleeves are assembled in the nested manner, the content is restricted from both transversal and longitudinal movements within between the at least two sleeves, by an interlocking retention between a couple of interlocking components respectively formed on the at least two sleeves.

9. The stick-shaped paper container according to claim 1, wherein the covering body and the base seat both are substantially the same in their entire structure and dimension, wherein while the covering body, the sleeving unit and the base seat are assembled together into the entire stick-shaped paper container, and the covering body and the base seat both are disposed in a reverse-position manner with relative to each other.

10. The stick-shaped paper container according to claim 1, wherein after the covering body, the sleeving unit and the base seat are assembled together into the entire stick-shaped paper container, the second end of the sleeving unit rests on an inner sidewall of the bottom terminal of the base seat.

11. The stick-shaped paper container according to claim 1, wherein the outermost cover sidewall and the outermost base sidewall both are respectively formed with flatted surfaces extended toward the same direction.

12. The stick-shaped paper container according to claim 1, wherein a transversally cross-sectional thickness of the standing cover wall is larger or smaller than a transversally cross-sectional thickness of the standing base wall.

13. The stick-shaped paper container according to claim 1, wherein the innermost seat sidewall is divided, by along the longitudinal centre line, into an annularly-narrowed inner diameter section, an annularly-widened inner diameter section, and an inner circular saddle formed on a boundary between both the annularly-narrowed inner diameter section and the annularly-widened inner diameter, wherein the second end passes through the receiving opening to enter inside the hollowed base chamber while the abutting terminal is disposed with the second end, the annularly-widened inner diameter section and the outermost sleeve sidewall both are respectively formed with flatted surfaces extended toward the same direction in such a way of constituting a plane-to-plane tight contact in a mutually resting-on manner between the annularly-widened inner diameter section and the outermost sleeve sidewall, and an outer diameter of the second end is smaller than an inner diameter of the inner circular saddle, thereby blocking the second end on the inner circular saddle from moving.

14. The stick-shaped paper container according to claim 1, wherein while the container height-to-width ratio is between 2-5.5, the maximum container width is between 12-23 mm.

15. A stick-shaped paper container, configured for accommodating a content therein, comprising:

a covering body, having a closed top distal end, a fitting-on distal end opposed against the top distal end, a standing cover wall located between the top distal end and the fitting-on distal end and formed around a longitudinal centre line, and a hollowed cover chamber formed, along the longitudinal centre line, between the top distal end and the fitting-on distal end, wherein the fitting-on distal end is formed with a fitting-on opening space-communicated with the hollowed cover chamber; and a base seat, configured for longitudinally supporting the content, having a closed bottom terminal, an abutting terminal opposed against the bottom terminal, a hollowed base chamber formed, along the longitudinal centre line, between the bottom terminal and the abutting terminal, and a standing base wall located between the bottom terminal and the abutting terminal and formed around the longitudinal centre line, wherein the abutting terminal is formed with a receiving opening space-communicated with the hollowed base chamber, the abutting terminal of the base seat is disposed at a position corresponding to the fitting-on distal end of the covering body, thereby accommodating the content within between both the covering body and the base seat; and wherein the covering body and the base seat both are integrally formed, respectively, only by a wet-fiber pulp-molding process where a male mold dredges up wet plant-fibrous pulps and then the male mold and a female mold both compression-mold the wet plant-fibrous pulps, in such a way that the entire structure of each of the covering body and the base seat all is formed with positive draft angles relative to the longitudinal centre line, and the stick-shaped paper container is constituted only by assembling the covering body and the base seat together.

16. The stick-shaped paper container according to claim 15, wherein the stick-shaped paper container has a maximum container height parallel to the longitudinal centre line, a maximum container width perpendicular to the longitudinal centre line, and a container height-to-width ratio, between 2-5.5, of the maximum container height being relative to the maximum container width.

* * * * *